United States Patent [19]

Irwin

[11] Patent Number: 4,478,135

[45] Date of Patent: Oct. 23, 1984

[54] ROTATING CYLINDER CONTINUOUS EXTERNAL COMBUSTION ENGINE

[76] Inventor: Everett F. Irwin, 430 Orangewood Dr., Dunedin, Fla. 33528

[21] Appl. No.: 424,396

[22] Filed: Sep. 27, 1982

Related U.S. Application Data

[60] Division of Ser. No. 202,946, Nov. 3, 1980, abandoned, which is a continuation-in-part of Ser. No. 358,190, Mar. 15, 1982, Pat. No. 4,413,486.

[51] Int. Cl.[3] ..... F02G 3/00

[52] U.S. Cl. ..... 91/492; 91/493; 60/39.63

[58] Field of Search ..... 123/44 D; 91/491, 492, 91/493; 277/81 R, 81 S, 81 P; 60/39.63

[56] References Cited

U.S. PATENT DOCUMENTS

| | | | |
|---|---|---|---|
| 2,530,337 | 11/1950 | McGogy | 91/492 X |
| 3,739,756 | 6/1973 | Villella | 123/44 D X |
| 3,899,880 | 8/1975 | Rohs | 277/81 R X |
| 4,062,330 | 12/1977 | Billings | 123/44 D X |
| 4,308,836 | 1/1982 | Wilkinson | 123/44 D |

FOREIGN PATENT DOCUMENTS

| | | | |
|---|---|---|---|
| 652883 | 11/1937 | Fed. Rep. of Germany | 123/44 D |
| 301416 | 9/1965 | Netherlands | 277/81 S |

*Primary Examiner*—Michael Koczo
*Attorney, Agent, or Firm*—Ronald E. Smith

[57] ABSTRACT

A general purpose fluid displacement device for use as an external combustion engine, a compound expansion engine, a hydraulic pump, or as an air compressor. At least one bank of circumferentially spaced pistons are operably connected to and radially disposed about a rotor member that is eccentrically disposed to an imaginary circle collectively defined by said pistons such that the amount of eccentricity of said rotor determines the throw of said pistons as the pistons orbit the rotor attendant operation of the device. The ends of the generally cylindrical device are capped by longitudinally spaced circular band members that rotate conjointly with the pistons and which have formed therein a plurality of ports corresponding in number to and in fluid communication with the rotating cylinders within which said pistons are reciprocably moveable, and by stationary circular band members having fluid intake and exhaust ports, said rotating and stationary ports intermittently and transiently aligning attendant operation of the engine. Several types of combustion chambers, several means for effecting in-unison movement between the rotor and the pistons, and several types of noise-attenuating exhaust ports are also disclosed.

7 Claims, 54 Drawing Figures

FIG. 5
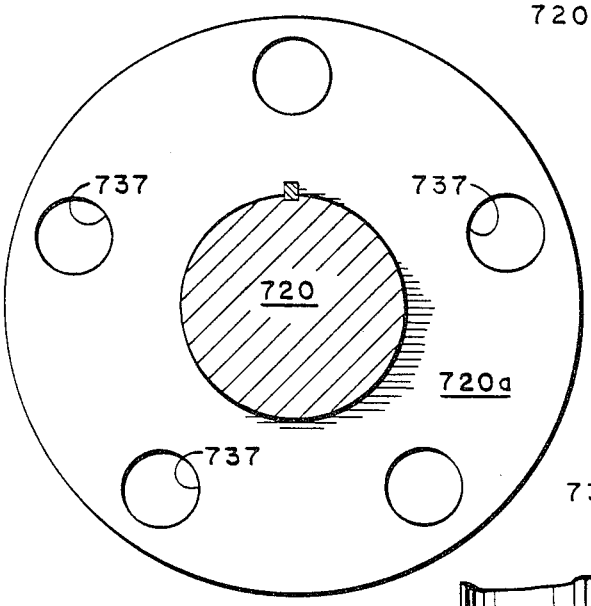
FIG. 4
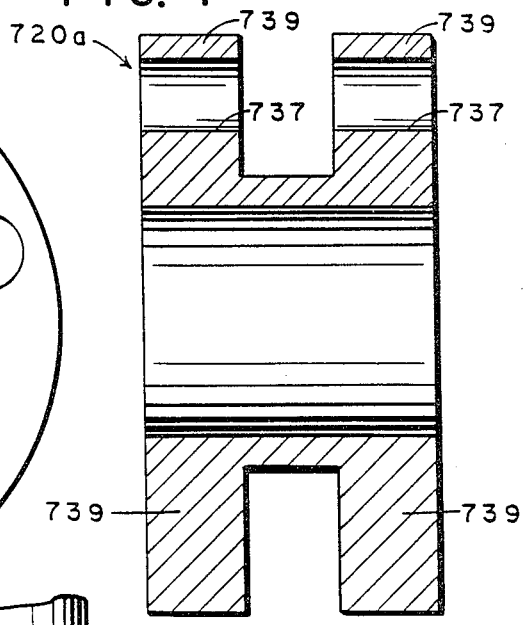
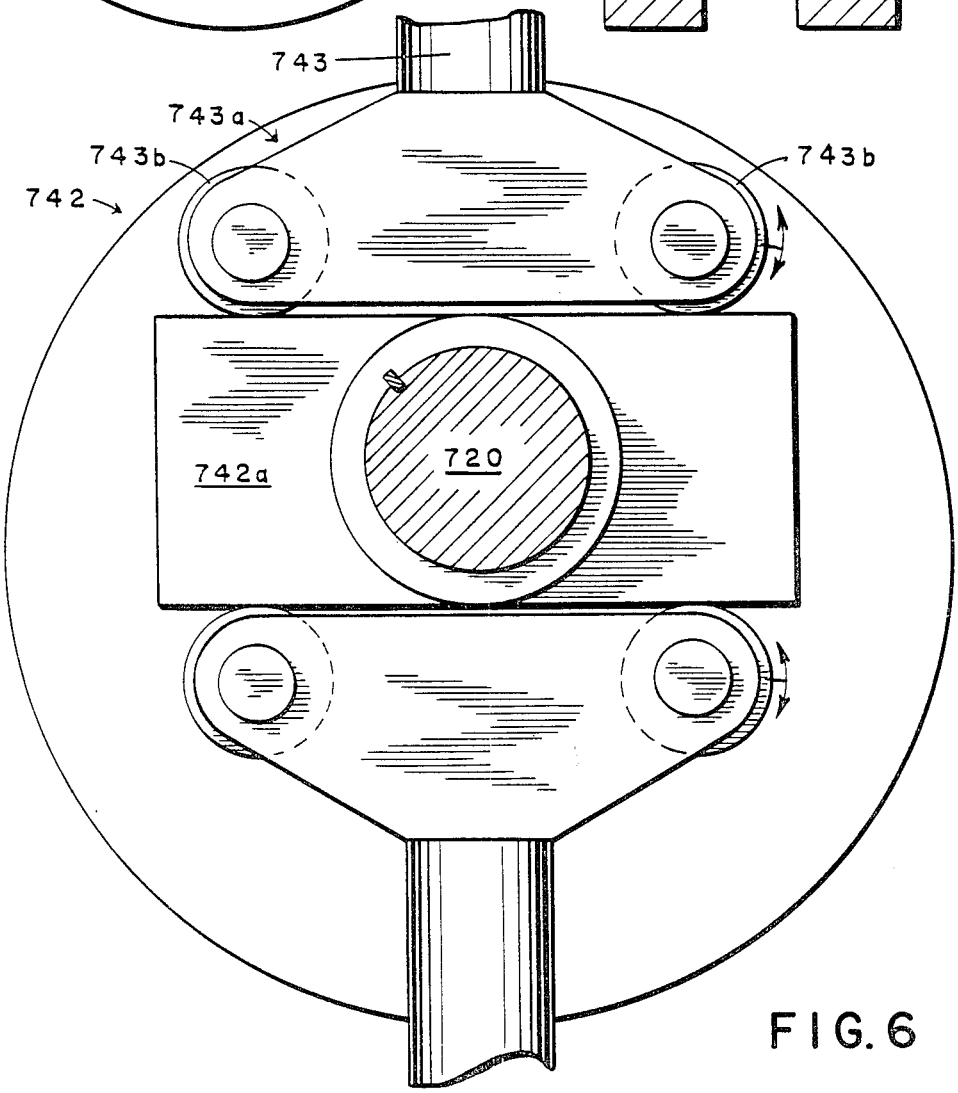
FIG. 6

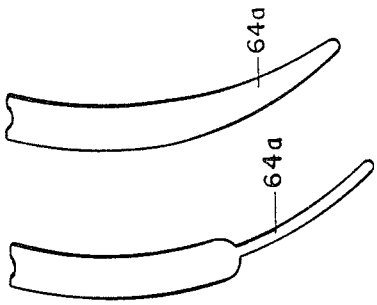
FIG. 8A
FIG. 8B
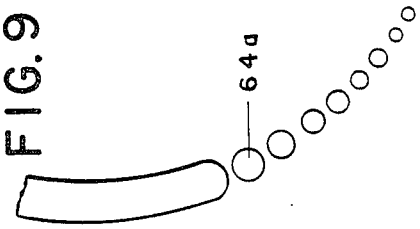
FIG. 9
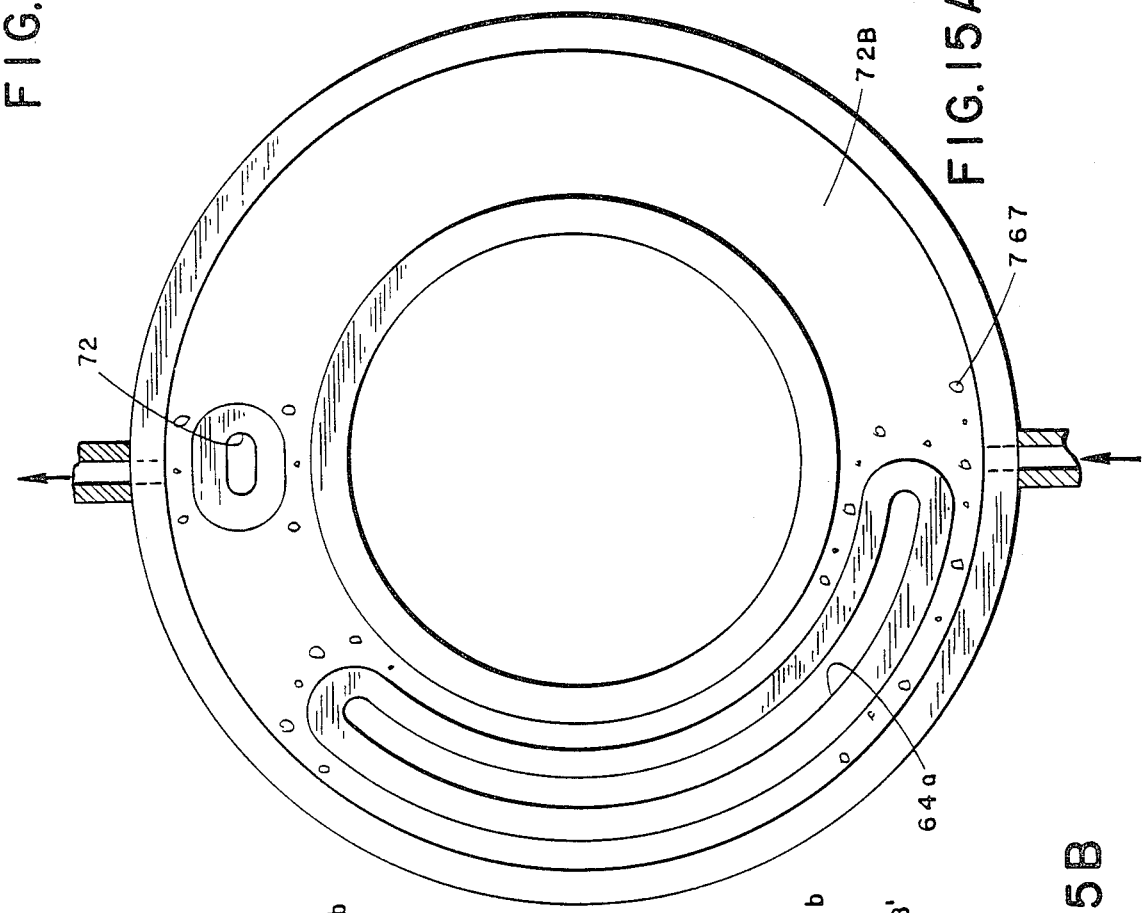
FIG. 15A
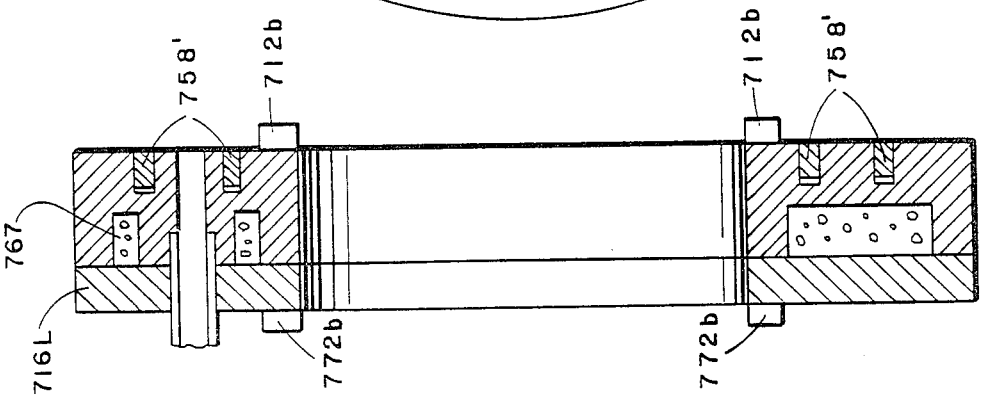
FIG. 15B

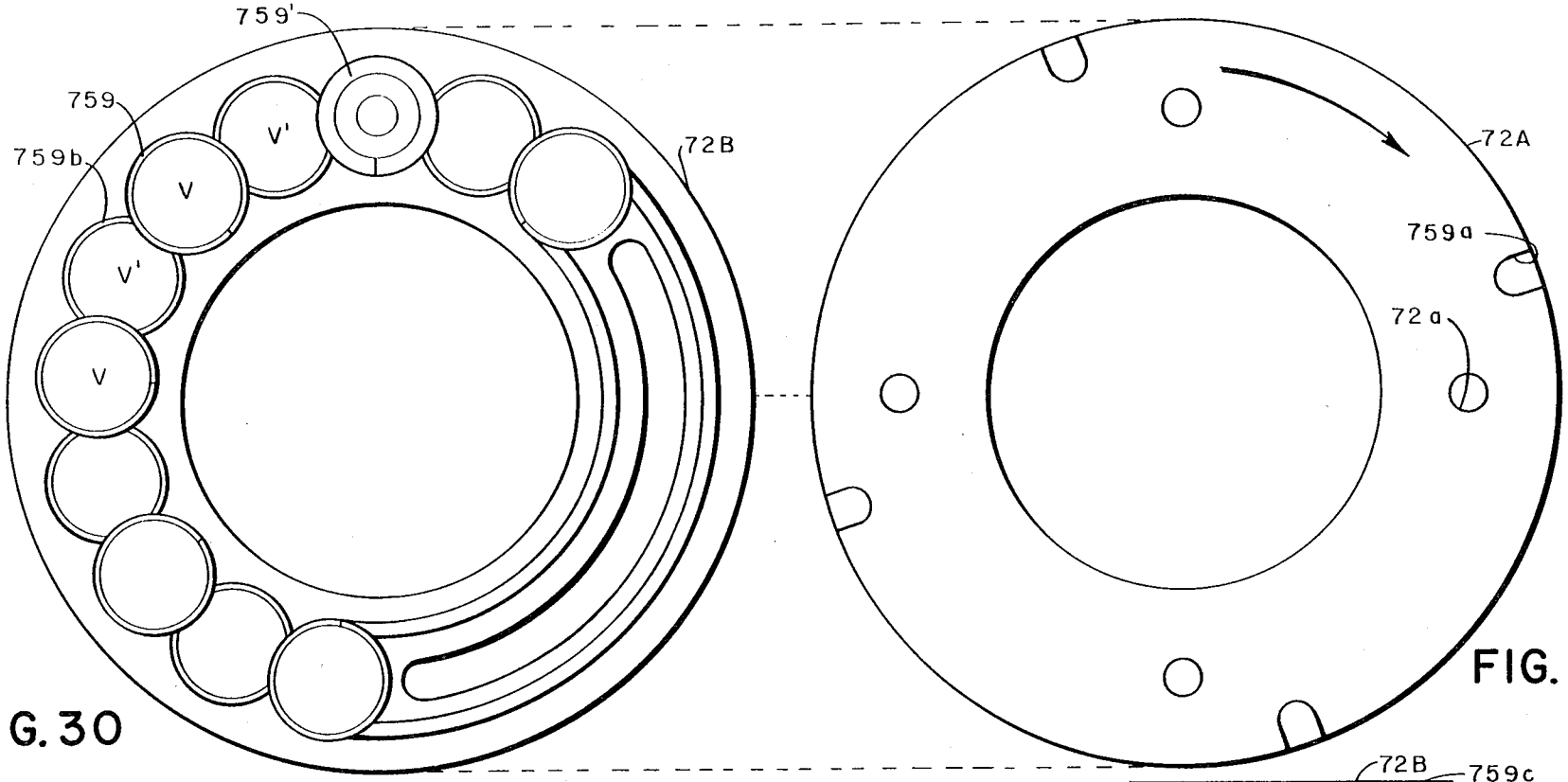
FIG. 29
FIG. 30
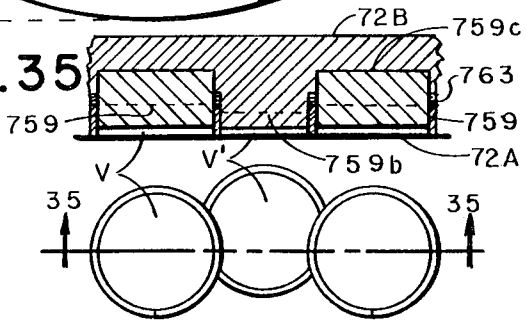
FIG. 35
FIG. 33
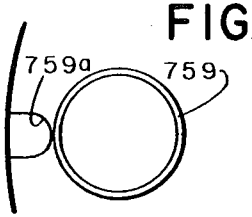
FIG. 34
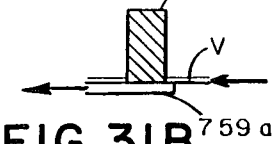
FIG. 31B
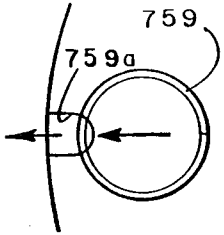
FIG. 32
FIG. 31A

ROTATING CYLINDER CONTINUOUS EXTERNAL COMBUSTION ENGINE

CROSS-REFERENCE TO RELATED APPLICATION

This application is a division of the inventor's application bearing Ser. No. 202,946, filed 11/3/80, now abandoned, which in turn was a continuation-in-part of application bearing Ser. No. 358,190, filed 3/15/82, now U.S. Pat. No. 4,413,486.

BACKGROUND OF THE INVENTION

1. Field of the Invention.

This invention relates generally to fluid displacement devices such as rotary engines and more particularly to improvements in rotary engines of the radial piston type, and which are adaptable for use as external combustion engines, fluid pumps or motors, a gas compressor or motor pump, or combinations thereof.

2. Description of the Prior Art.

For a complete description of the prior art, reference should be made to the inventor's co-pending application.

SUMMARY OF THE INVENTION

The operation of the device disclosed herein bears a degree of similarity to the operation of the device disclosed in the above-identified application of the inventor, and reference should be made thereto for a detailed summary of the principles which underlie the operation of the engine.

The present invention is perhaps best illustrated and described in the context of a twin bank external combustion engine wherein one bank of radially disposed pistons is dedicated to the intake of ambient air and the compression thereof which pumps such withdrawn air to a combustion chamber to thereby provide one of the three (3) needed ingredients to sustain a continuous combustion (fuel, heat, and oxygen).

An axially spaced bank of radially-disposed pistons is dedicated to imparting torque to a rotor means eccentrically disposed radially inward of the pistons of the twin banks, and to the exhaust of combusted fuel.

Each of the cylinders of the air intake/compressor bank is in continuous fluid communication with a longitudinally-disposed port individual thereto. These rotating ports intermittently enter into fluid communication with stationary ports that are connected in fluid communication with either ambient air or the combustion chamber air inlet. The stationary ports are specifically disposed so that ambient air is drawn into individual cylinders when the piston therein is undergoing radially inward travel and so that such drawn in air is directed into the combustion chamber when the pistons are undergoing radially outward travel.

Similarly, each transient alignment of ports on the power side of the engine effects radially inward piston travel when a rotating port aligns with a stationary port in fluid communication with the combustion chamber outlet, and the exhausting of spent gases into the atmosphere or into a compound expansion bank of pistons is effected when the rotating ports successively align with the stationary exhaust port, such pistons then undergoing radially outward travel. In one embodiment, the eccentrically-disposed rotor is circular in section, and crank pins connect the rotor and pistons so that true rotary motion is achieved.

A block-like element is preferably keyed to the rotor to provide opposing flat surfaces so that a means for yoking the movements of the pistons and rotor may ride thereagainst, said yoking means having radially inwardly-disposed wheel means for rotatable engagement with such flat surfaces.

In other embodiments, flat-surface-providing block members are also keyed to the circular in section rotor, but the crank pins are obviated. The pistons may be provided with radially inward wheel assemblies, diametrically opposed ones of which are rigidly interconnected to accomplish the yoking function.

Combustion chambers having plural tangentially-disposed air inlets and means for steam or water injection are also disclosed, as are novel gradually-opening noise-attenuating exhaust ports, and sealing means characterized by interconnected countersunk elements, said countersunk elements and the means for interconnecting the same collectively defining fluid tight chambers to prevent leakage of the gaseous fluids that drive the engine.

It is therefore understood that a primary object of this invention is to provide a fuel-efficient engine of compact dimensions for general applications and as a power plant for automobiles.

A closely related object is to provide such an engine of the rotary type wherein true rotary motion is achieved so that engine vibration is held to an irreducible minimum.

Another object is to provide such an engine having a very high degree of reliability and concommitant low maintenance costs as a result of having few moving parts, and as a result of having essentially passive valving mechanisms that control engine operation, said valving mechanisms comprising rotating and non-rotating ports that transiently and intermittently align attendant engine operation.

Still another object is to provide such an engine that is readily and efficiently air cooled.

Yet another object is to provide such an engine in the form of an external combustion engine to harness the advantages inherent in such engines, including the elimination of spark plugs to a substantial degree as a result of maintaining a continuous combustion, and the elimination to a substantial degree of metal fatigue and decreased engine efficiency resulting from the alternating heating and cooling of cylinders required in internal combustion engines.

Another object is to provide such an engine having an eccentrically-disposed rotor so that the amount of eccentricity thereof determines the length of the piston strokes.

A closely related object of the invention is to show several methods and practical structural means for accomplishing in-unison movement between rotating pistons and an eccentrically disposed rotating drive shaft or rotor so that even more means for accomplishing the needed rotor-piston yoking will be apparent.

Further objects relate to improvements in combustion chambers that result in more efficient fuel burn.

It is another object of the invention to disclose how the inventive fluid displacement device can be operated as a pump, a vaccuum pump, an air compressor, a compound expansion engine, and other such forms of fluid pressure devices.

Additional objects will become apparent hereinafter.

The invention, accordingly, comprises the features of construction, combination of elements, and arrangement of parts that will be exemplified in the construction hereinafter set forth, and the scope of the invention will be set forth in the claims.

BRIEF DESCRIPTION OF THE DRAWINGS

For a fuller understanding of the nature and objects of invention, reference should be made to the following detailed description taken in connection with the accompanying drawings, in which:

FIG. 4 is a vertical sectional view of the hub means that is keyed to the drive shaft.

FIG. 5 is an end elevational view of the hub means that is keyed to the drive shaft.

FIG. 6 is an end elevational view of the radially innermost portion of the preferred yoking means, showing how a roller support surface is keyed to the drive shaft.

FIG. 8A is a side elevational view of a preferred gradually-opening, noise-attenuating exhaust port.

FIG. 8B is a side elevational view of another exhaust port.

FIG. 9 is a side elevational view of yet another noise-attenuating exhaust port.

FIG. 15A is an end elevational view of the means for cooling the non-rotating circular band associated with the power bank of pistons.

FIG. 15B is a vertical sectional view of the circular band shown in FIG. 15A.

FIG. 29 is a side elevation of a rotating circular band having pressure relief slots.

FIG. 30 is a side elevation of a non-rotating circular band having circular sealing rings.

FIG. 31A depicts a pressure relief slot shown in FIG. 29 in fluid communication with a circular sealing ring of FIG. 30.

FIG. 31B depicts the elements of FIG. 31A in side elevation.

FIG. 32 depicts a pressure relief slot of FIG. 29 in adjacent relation to the burner inlet shown in FIG. 30, showing that the thicker sealing ring surrounding the burner inlet prevents the escape of combusted gases from the volume surrounded by such thicker sealing ring.

FIG. 33 depicts an alternative arrangement of the circular sealing rings, showing alternate ones thereof disposed radially inwardly of the remaining sealing rings.

FIG. 34 depicts a pressure relief slot shown in FIG. 29 in adjacent relation to a radially inwardly disposed sealing ring of the type shown in FIG. 33, depicting the by-pass relation between said pressure relief slot and said offset sealing ring.

FIG. 35 is a cross sectional view taken along line 35—35 of FIG. 33.

Similar reference numerals refer to similar parts throughout the several views of the drawings.

DETAILED DESCRIPTION OF THE PREFERRED EMBODIMENT

Figure 1:
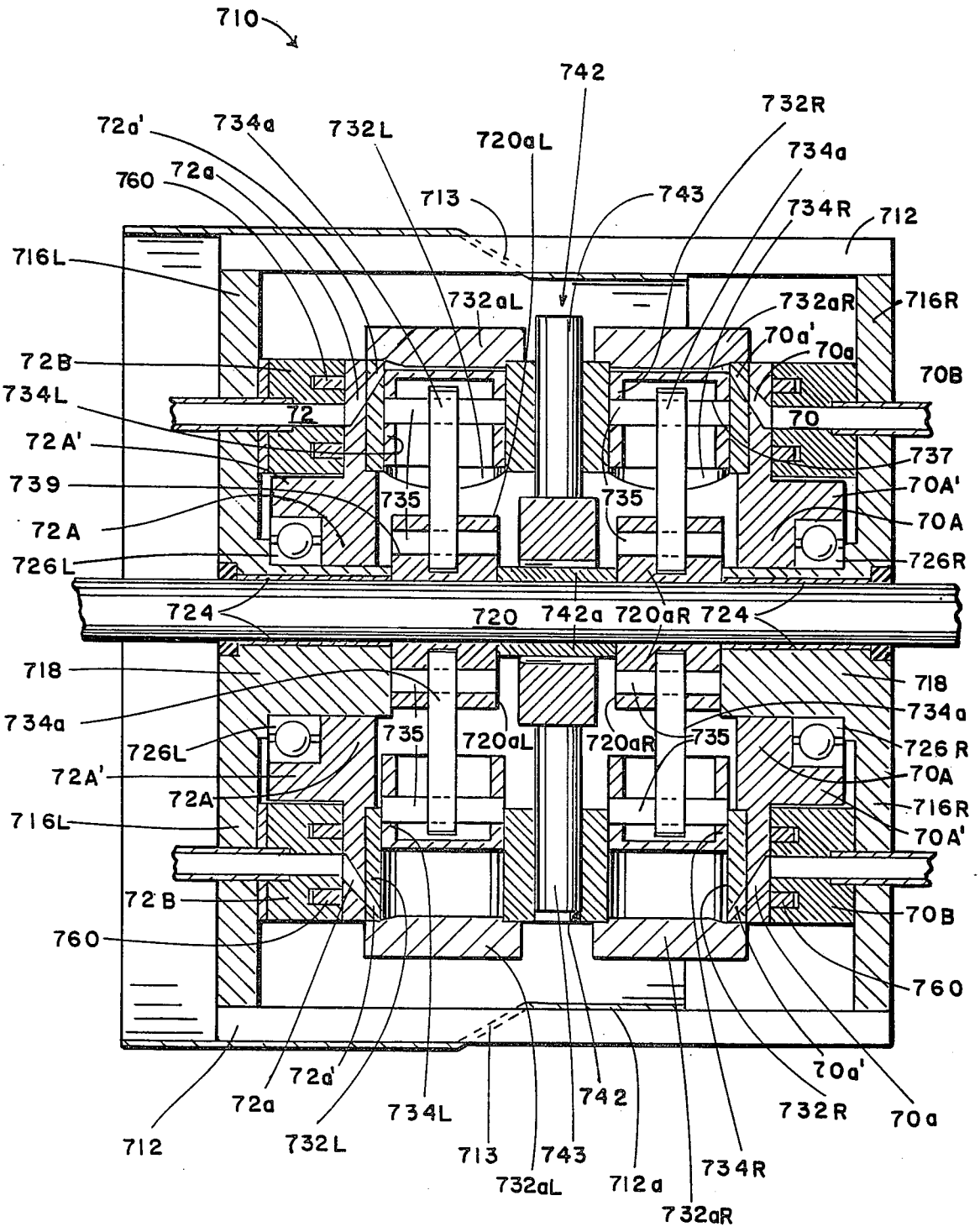
FIG. 1 is a longitudinal cross-sectional view of the preferred embodiment of the invention, taken along line 1—1 of FIG. 2.

An engine employing the concept mentioned in the above-identified co-pending application of the inventor in connection with FIGS. 49 and 50 thereof is shown in longitudinal section in FIG. 1 and will be described in detail herein.

The rotor shown in the earlier application incorporates planar faces for operative engagement of the pistons. In the embodiment now to be described, the rotor is circular in transverse section. Furthermore, the present embodiment employs cylinder heads individual to each cylinder, thereby eliminating the need for the annular sealing rings 58 and the wiper vanes 60 shown and described in the earlier application. Greater efficiencies are also achieved by relocation of the intake port 62 and the exhaust outlet 64 to opposing ends of the gnerally cylindrical-in-configuration engine, in lieu of providing the same on opposite sides of the cylindrical housing 12 of the earlier embodiment. Such port re-location allows the housing itself to be reduced to frame status, thereby saving additional weight. A further synergistic effect of the present arrangement of parts lies in the greater cooling capabilities made possible by the elimination of the close rotary sliding fit between the rotary cylinder block of the earlier-described embodiment, which cylinder block is now eliminated, and the inner peripheral walls of the stationary housing of such earlier invention. Due to the additional space now provided between the rotating cylinders and the frame of the engine, a shroud means can be provided for directing cooling air onto heat transfer fins that are mounted on the cylinders at an angle to provide a fan-like effect.

The provision of a circular-in-section rotor also allows elimination of the base plates 36 and the bridle rings 42 of the earlier invention.

Figure 2:
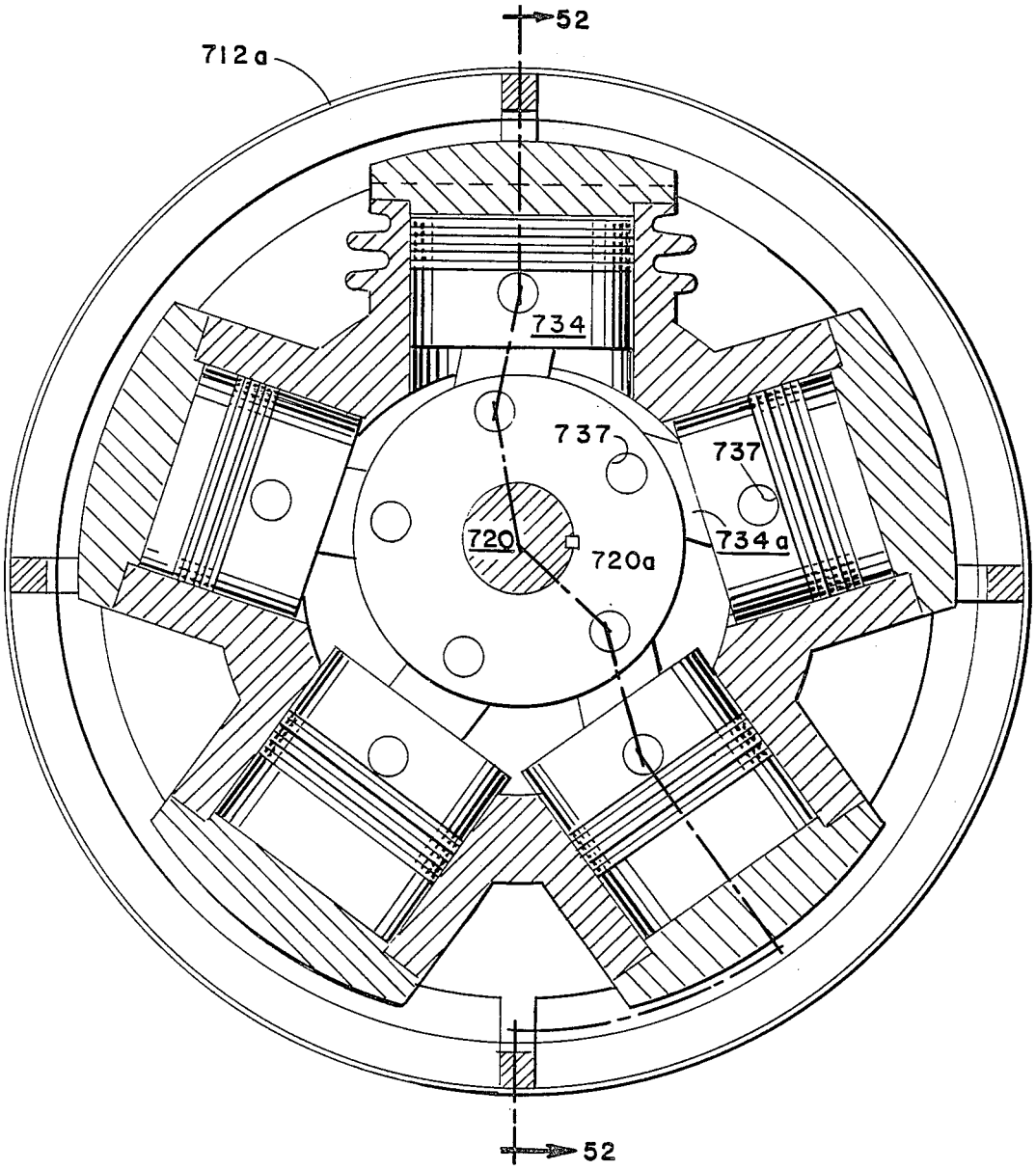
FIG. 2 is a transverse sectional view showing the radial disposition of the pistons around the circular-in-section drive shaft.

Referring now to FIG. 1, there it will be seen that the present embodiment of the invention, generally designated 710, includes a pair of axially-spaced piston banks 734L and 734R, dedicated to power expansion/exhaust and air intake/compression, respectively. The preferred number of pistons 734 in each bank, as shown in FIG. 2, is five (5). As in the first-filed application, the pistons 734 are radially disposed, in equidistant spaced-apart relation, to the axis of symmetry of the engine 710. Each piston is respectively slidingly disposed in a different one of the complementally-formed cylinders 732L, 732R. As shown in FIG. 2, each cylinder 732 is provided with heat transfer fins 732*b* on the exterior wall thereof, and with heat transfer fins 732*a* on the top thereof, and the fins 732*a* are angularly disposed relative to the vertical to provide a fan effect when cooling air is directed to impinge thereagainst by the shroud means hereinafter disclosed.

Figures 3A, 3B, 3C, 3D, 3E, 3F, 3G, 3H, 3I:
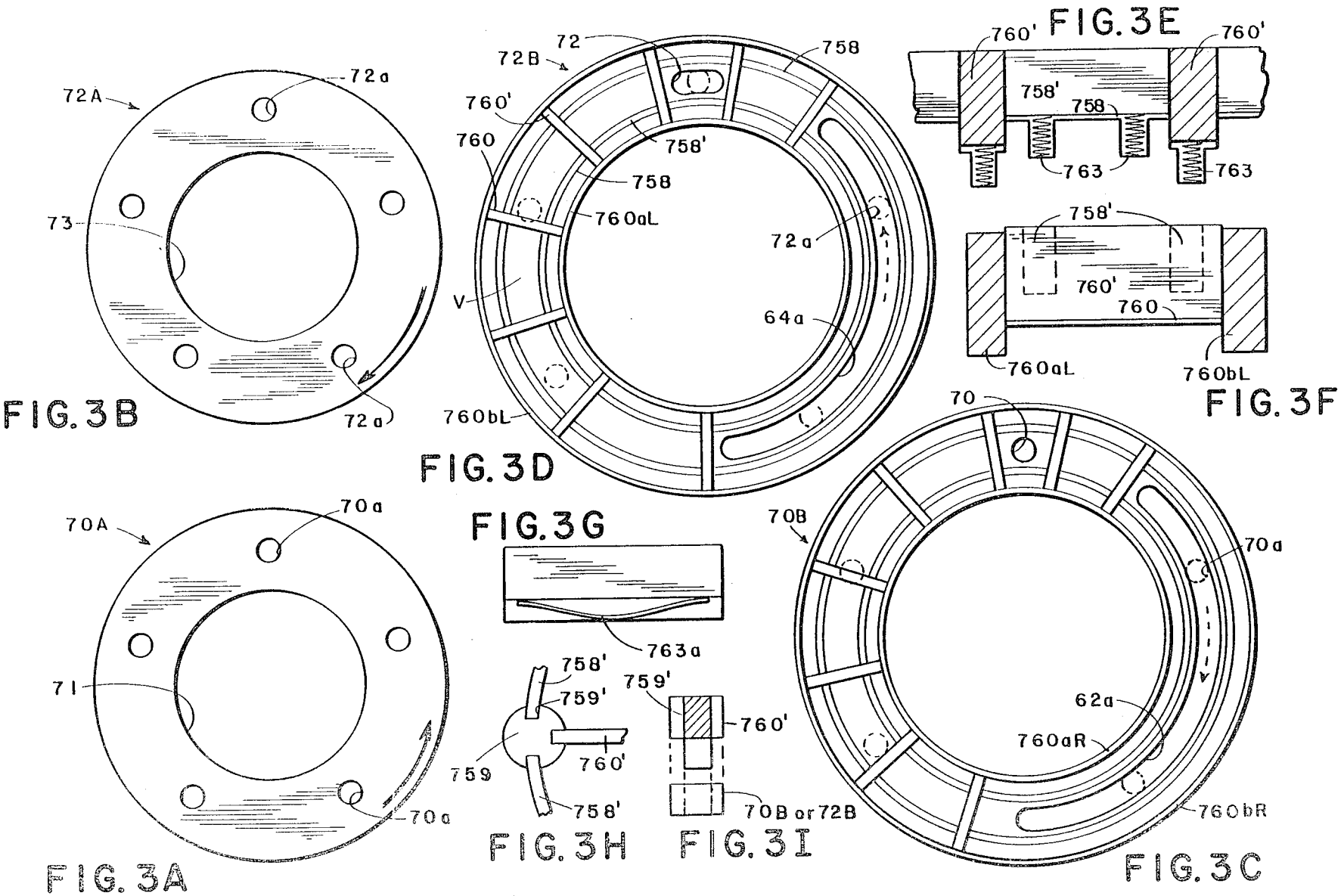
FIG. 3A is a side elevational view of the rotating circular band associated with the compressor bank of pistons.
FIG. 3B is a side elevational view of the rotating circular band associated with the power bank of pistons.
FIG. 3C is a side elevational view of the non-rotating circular band associated with the compressor bank of pistons.
FIG. 3D is a side elevational view of the non-rotating circular band associated with the power bank of pistons.
FIG. 3E is a cross sectional view showing the greater axial depth of the channels associated with the radial sealing vanes relative to the axial depth of the channels associated with the annular sealing rings, and showing the preferred biasing means.
FIG. 3F is a cross sectional view showing the means for capping the opposed ends of the radial channels for the radial vanes.
FIG. 3G shows an alternate form of biasing means.
FIG. 3H shows an alternate method of interconnecting the respective intersections of the rings and vanes.
FIG. 3I shows how the cylinder of FIG. 3H is set into the respective non-rotating circular bands.

FIGS. 3A and 3B are end elevational views of the rotating circular bands 70A and 72A which are disposed axially outward of the compressor bank of pistons 734R and the power bank of pistons 734L, respectively, as shown in FIG. 1. Each rotating circular band 70A, 72A is open centrally thereof, as at 71, 73, respectively, as shown clearly in FIGS. 3A and 3B, said bands having a generally toroidal configuration.

The cylinders 732L, 732R abut and rotate conjointly with the circular bands 72A, 70A respectively. Accordingly, a longitudinally-disposed channel means 72*a*', 70*a*'formed in the corresponding cylinder, respectively, is in continuous fluid communication with the ports 72*a*, 70*a* that are formed, respectively, in the circular bands 72A, 70A, as shown in FIG. 1.

Each circular band 72A, 70A has an axially-extending portion 72A', 70A' that is specificayly structured for rotatable engagement with annular main bearings 726L, 726R, said bearings 726 being interposed between rotatable circular bands 72A, 70A and the stationary end wall members 716L, 716R to permit relative rotation therebetween.

As in the embodiments of the earlier application, the end walls 716 are provided with inwardly-extending bearing sleeves or bosses 718 that are eccentrically apertured. Bushing members 724 permit relative rotation between the stationary bosses 718 and the circular-in-section opposed ends of the rotor 720 journaled therein.

FIGS. 3C and 3D show, respectively, stationary circular bands 70B, 72B that are disposed in sandwiched relation to the rotatable circular bands 70A, 72A and the non-rotatable end walls 716R, 716L, respectively.

The stationary circular bands 70B, 72B are perforated or apertured as at 62*a*, 70 and 64*a*, 72 respectively. The ports 62*a*, 64*a* are elongate and arcuate in configuration and respectively form air intake and exhaust outlet means for the respective banks of pistons associated therewith. Port 72 is truncated and rectilinear in configuration, port 70 is circular, and such ports respectively form passageways that provide fluid communication between the combustion chamber, hereinafter disclosed, and the respective banks of pistons.

Specifically, air that has been compressed attendant radially outward travel of a piston 734R enters the combustion chamber through stationary port 70 formed in the stationary circular band 70B, upon alignment of the port 70 with a rotating port 70*a*. Combusted fuel exits the combustion chamber to successively impinge upon the pistons 734L, through the non-rotating port 72, upon alignment thereof with a rotating port 72*a*. Such interaction of the pistons 734L and the expanding gases of the combusted fuel imparts radially-inward travel to such pistons, sequentially, to thereby impart rotation to the rotor 720 through a mechanism that will be described hereinafter.

Ambient air is resistively drawn into the cylinders 732R, sequentially, as the pistons 732R travel radially inward, when nonrotating arcuate port 62*a* aligns with the rotating ports 70*a* as the engine or other fluid pressure device operates. The exhaust gases are expelled through arcuate port 64*a* by the radially outward traveling pistons 734L as rotating ports 72*a* successively align with the non-rotating port 64*a* attendant rotary operation of the device 710. As in the earlier-disclosed embodiments of the prior application, each 360° revolution of the engine 710 accomplishes the four strokes of the Otto engine, each bank accomplishing two (2) of the total number of strokes.

FIG. 1 depicts an engine 710 with the stationary port 72 formed in the circular band 72B in alignment with a rotating port 72*a*. One of the pistons 734L has just completed its radially outward stroke and is about to commence its radially inward stroke. A piston 734R is shown at its Top Dead Center (TDC) position, with its associated rotating port 70*a* in alignment with the circular port 70.

Of course, as shown in FIG. 1, the end walls 716L and 716R are also provided with cut-away portions in registration with the non-rotating ports 62*a*, 70, 64*a*, 72. The rotating ports and stationary ports collectively act as AND gates, logically speaking, since the transient alignment therebetween enables the operation of the engine. The provision of such coincidence detecters is an important feature of this invention.

It should be understood that the pistons of the respective banks need not be in longitudinal alignment, and that they can be made to reach their respective TDC and BDC positions in unison or out of step with one another.

The means for operatively engaging the pistons 734 and the rotor 720 to achieve in unison movement therebetween is best seen in FIGS. 2, 4 and 5, taken in connection with FIG. 1. FIG. 1 shows that each piston 734 has a piston rod 734*a* associated therewith, and that the opposing ends of each piston rod 734*a* are secured by wrist pin means, collectively designated 735, to the piston and to a hub means 720*a* that is keyed to the rotor 720, and therefore conjointly rotatable therewith. The hub means 720*a*, in the twin bank embodiment of the invention, comprises a pair of substantially identical, axially-spaced members, 720*a*L, 720*a*R. Each member 720*a* is integrally formed, circular in end view as seen in FIG. 5, and has an "H" configuration in longitudinal section, as shown in FIG. 4. Aligned, longitudinally disposed, circumferentially-spaced bores 737 are formed in the axially-spaced, transversely-disposed annular ring portions 739 of the hub means 720*a*, for reception therethrough of the piston rod-impaling wrist pins 735, said piston rods 734*a* thereby being disposed in sandwiched relation to said transversely opposed annular ring portions 739, in substantially friction-free relationship therewith. The eccentric alignment of the rotor 720 relative to the axis of symmetry of the struts 712 of the engine 710, in view of the conjoint rotation of the rotor-carried hub means 720*a* and each cylinder 732, effects reciprocal movement of the pistons 734 within their associated cylinders 732, and the amount of the eccentricity determines the length of the piston strokes.

Figure 7B:
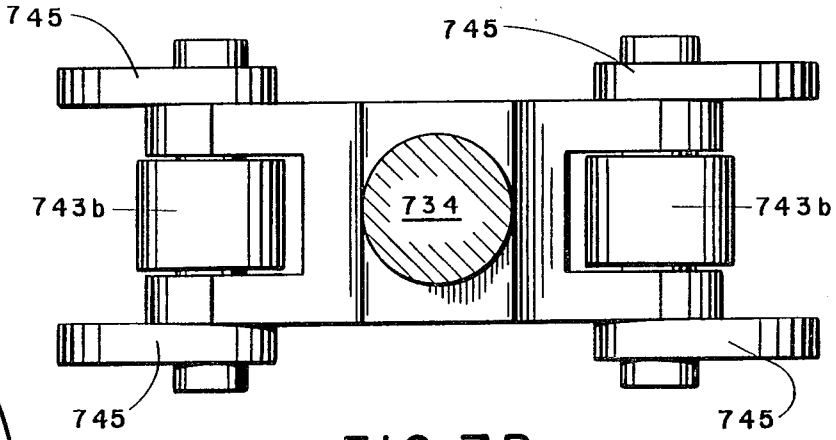
FIG. 7B is a top plan view of the assembly shown in FIG. 7A.
Figure 7A:
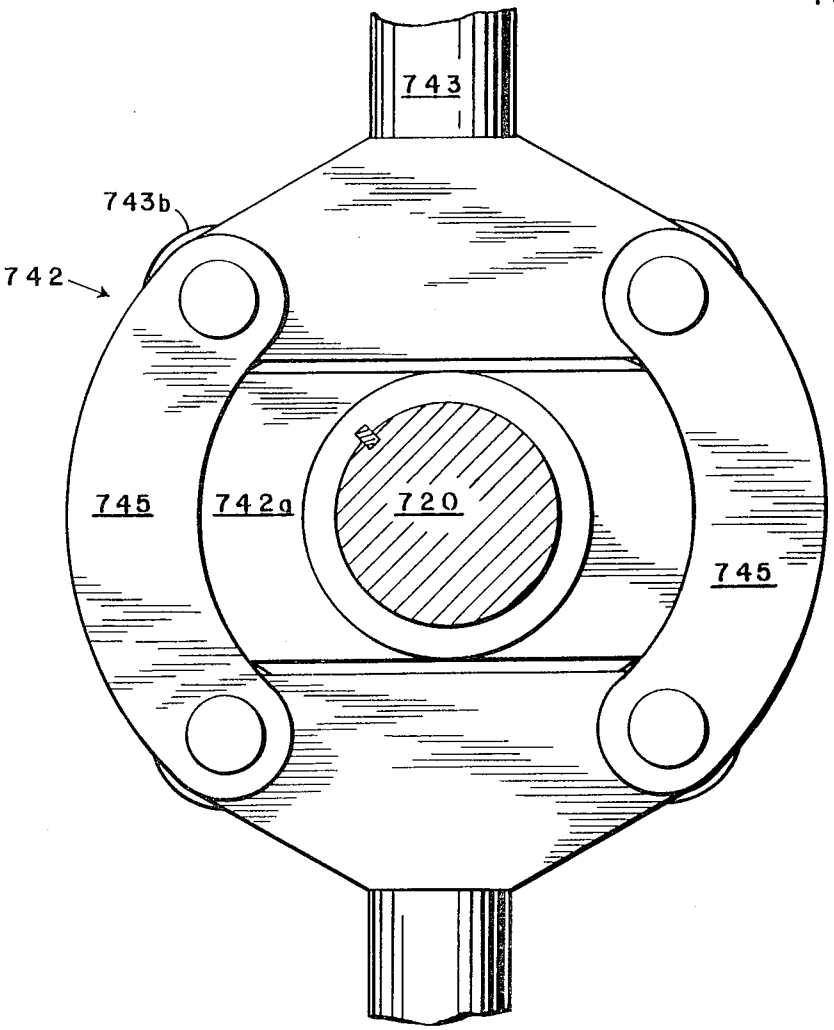
FIG. 7A is an end elevational view like that of FIG. 6, showing further the means for interconnecting opposed ones of the yoking members.

As in the earlier-disclosed embodiments, it is necessary to provide a yoking means to assure movement in unison between the pistons and the rotor 720. The preferred yoking means is shown in FIGS. 6, 7A and 7B, and is designated generally as 742. Reference to FIG. 1 indicates that the yoking means 742 is preferably interposed between the axially-spaced piston banks 734L, 734R. FIG. 1 also indicates that the yoking means 742 associated with a given pair of axially-spaced, longitudinally aligned pistons 734 is radially extended when said pistons are radially extended, and radially retracted when said pistons are radially retracted. However, the yoking means 742 need not be in longitudinal alignment with the pistons as shown.

The yoking means 742 includes a block-like, transversely-disposed, support surface member 742*a* that is keyed to and conjointly rotatable with rotor 720. The shank portion 743 of the yoking assembly 742 terminates at its radially inward portion in a wheel-mounting assembly, indicated generally as 743*a*. The transversely-spaced apart wheel members: 743*b* are rotatably mounted in conventional fashion for rotatable engagement with an associated planar face of the support surface member 742*a*.

FIG. 7B shows that each wheel member 743*b* is longitudinally spaced apart from a substantially identical wheel member, and that opposing pairs of wheel members 743*b* are interconnected by curvilinear members 745, there being a total of four (4) such curvilinear members 745 in this particular arrangement. The curvilinear members 745 serve to rigidly connect the opposing yoking menbers 743*a*, so that displacement of a given yoking member 743*a* is substantially simultaneously communicated to its associated, opposing yoking member 743*a*, thereby assuring positive, synchronous rotation between the pistons 734 and the rotor 720.

FIGS. 8A, 8B, and 9 show three configurations for the exhaust port 64*a* that serve to attenuate the noise inherent in the operation of any engine. In all embodiments, the leading edge of the port 64*a* presents a reduced opening for the exhaust gases so that the exhaust operation is less precipitous, or abrupt, than in the embodiment disclosed earlier. The more gradual discharge of the combusted fuel reduces the noise that would otherwise accompany such discharge.

Figure 10:
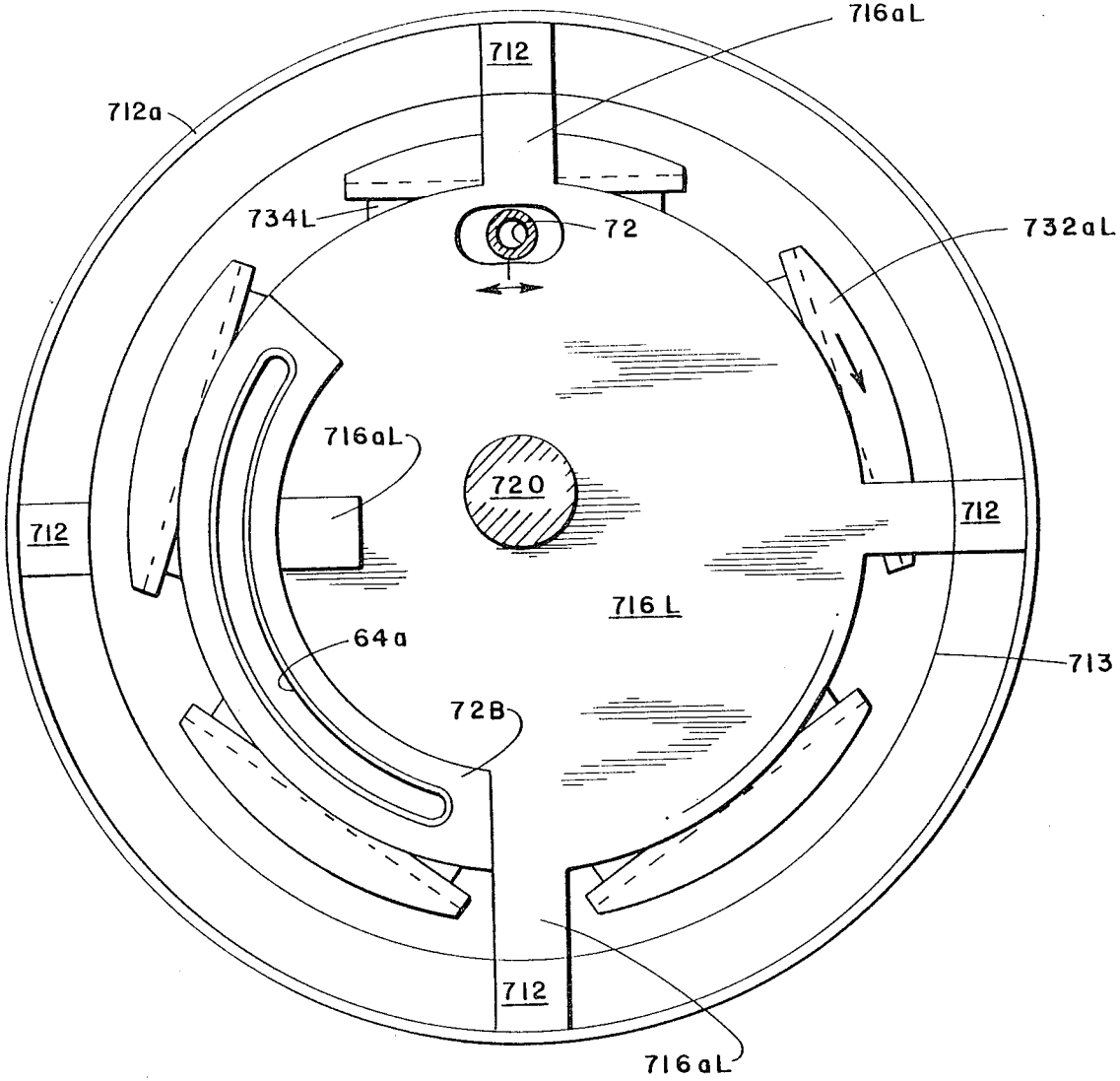
FIG. 10 is an end elevational view of the engine showing how the end wall is cut away to provide openings for the exhaust port and burner inlet.

FIG. 10, taken in connection with FIG. 1, shows the shroud 712*a* that envelopes the engine 710 and which is specifically configured to direct cooling air onto the heat transfer fins 732*a*L. FIG. 10 shows that end wall 716L is specifically configured to have a plurality of circumferentially-spaced projecting portions 716*a*L. The end wall 716R, not shown in FIG. 10, is also provided with corresponding, axially-aligned projecting portions 716*a*R. The projecting portions 716*a*L, 716*a*R support the longitudinally-disposed strut members 712 that interconnect the opposing end walls 716L, 716R. The strut members 712 supportingly engage the cylindrical shroud member 712*a* that, as seen in FIG. 1, has a beveled portion 713 that reduces the diameter of the shroud 712*a* about mid-length of the power bank of pistons 734L, radially outward thereof. In this manner, the shroud 712a directs incoming air against the fins 732*a*L (see FIGS. 1 and 2). The cooling fins are set at an angle to draw air therethrough, as mentioned earlier hereinabove.

Figure 11:
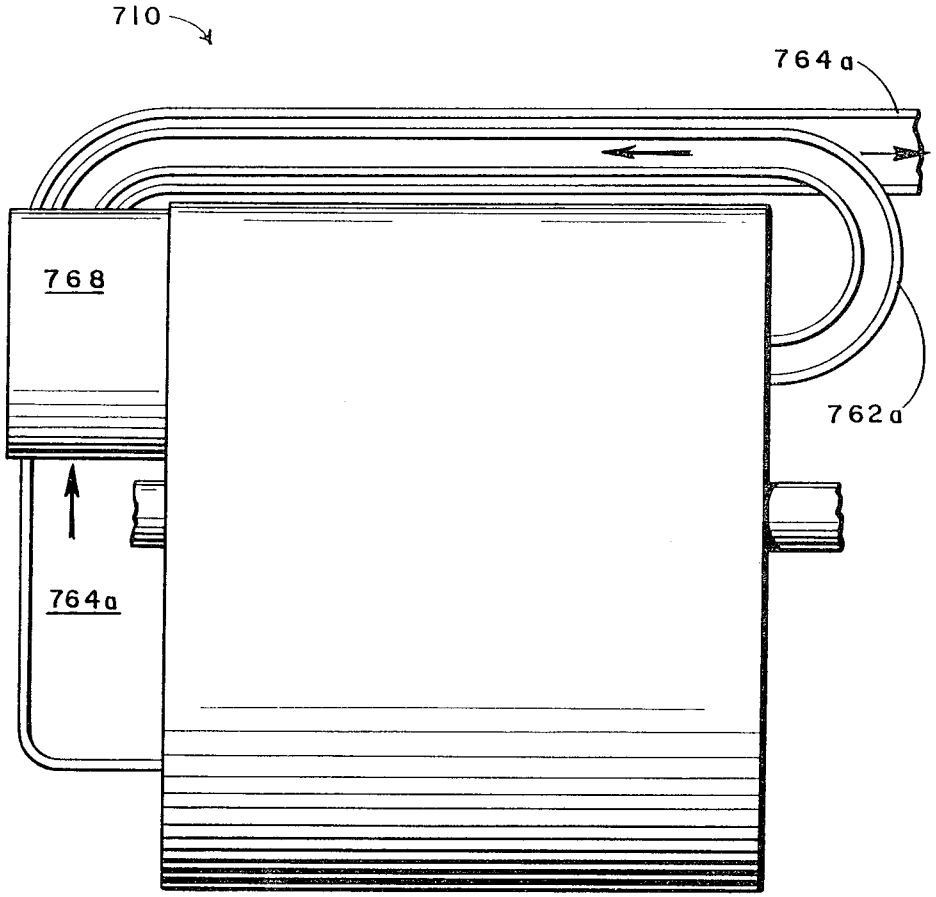
FIG. 11 is a side schematic diagram of the engine, showing the means for pre-heating the compressed air prior to its entry into the combustion chamber.

FIG. 11 shows that the novel combustion chamber to be described hereinafter is affixed to the engine 710 adjacent the power bank of pistons 734L, and that compressed air from the compression bank of pistons 734R is routed to the combustion chamber via conduit 762*a* that is jacked by conduit 764*a* so that hot exhaust gases flowing through conduit 764*a* will pre-heat the air flowing into the combustion chamber via conduit 762*a*.

When the rotating ports 70*a*, 72*a* are mis-aligned with the stationary ports 62*a*,64*a* and 70,72, respectively, the compressed air or combusted fuel must be prevented from leaking out of the engine, if power loss is to be avoided. Two different means for sealing the engine against such leaks are shown in FIGS. 3C–3G and FIGS. 3H, 3I. A pair of concentrically-aligned, spaced apart annular grooves 758, 758 of predetermined depth are milled in each stationary circular band 70B, 72B, as best depicted in FIGS. 3C–F. A predetermined plurality of radially disposed (relative to the axis of symmetry of the housing) or orthogonally disposed (relative to an intersecting groove 758) grooves or ways, collectively designated 760, of predetermined depth greater than the predetermined depth of the annular grooves 758, is then milled in each stationary circular band 70B, 72B, on the inner face thereof. Since each circular band is open centrally thereof, the radially innermost end of each radial groove 760 must be capped by ring means 760*a*L, 760*a*R that are inserted in the central opening of the circular bands 72B,70B respectively, after the radial milling operation has been completed. Accordingly, the outer diameter of each ring means 760*a* is slightly less than the inner diameter of the central opening of each band 70B, 72B, to achieve a tight fit therebetween. A similar sealing ring 760*b*L,760*b*R caps the radially outermost end of each radial groove 760. The annular grooves 758 and the radial grooves 760 are open-topped and have a bore configuration. An extension portion, also of bore configuration, houses a coil-type bias means 763 or a leaf-type bias means 763*a*, as clearly shown in FIG. 3G. Positioned atop the bias means 763 or 763*a* are annular sealing rings 758' and radial wiper vanes 760'. The bias means 763 or 763*a* urge the rings 758' and vanes 760' outwardly so that the rings 758L', 758R' and vanes 760L', 760R' slidingly engage the outwardly facing sides of the rotating circular bands 72A, 70A, respectively. In this manner, gaseous fluid under pressure exiting a given rotating port is discharged into a volume bounded by given segments of the rings 758' and vanes 760', such as the volume indicated as "V" in FIG. 3D. In the absence of radial vanes 760', the gases would escape from such a volume by flowing under the annular rings 758'. Excessive angular spacing of the radial vanes 760' will permit excessive lengths of the annular rings 758' to be lifted by the gases, thereby unnecessarily increasing the amount of sliding friction between the rings 758L',758R' and the radial vanes 760L',760R', respectively. Closer angular spacings of the radial vanes 760' also serves to isolate the angularly adjacent rotating cylinders from one another.

The sealing of the volume V is enhanced due to the provision of radial bores 760 having a greater depth than the annular bores 758, as clearly shown in FIGS. 3E, 3F.

Another embodiment, however, shown in FIGS. 3H and 3I, obviates the need for the vane-capping rings 760*a*, 760*b* and further obviates the need to provide bores 760 having a greater depth than the annular bores 758. A cylinder member 759 is set into the interior faces of the stationary plates 72B, 70B at the respective intersections of vanes 760' and rings 758'. The cylinder 759 is slotted as at 759' to receive the corresponding ends of each vane 760' and ring 758'.

Regardless of whether volume V is defined by the embodiment shown in FIGS. 3C–3G or by the embodiment shown in FIGS. 3H and 3I, empirical studies may show that spacings of the vanes 760' and the rings 758' other than the spacings shown in such Figures are optimal. When the vanes 760' and the rings 758' are well-placed, it has been found that virtually no friction losses occur as a result of the just-described sealing means in the absence of pressures thereagainst.

Another novel and unexpected feature of the present invention is the fact that rotation of the circular band 72B affects the operation of the engine. Although circular band 72B is generally referred to herein as stationary, it can be at least slightly rotatably mounted to permit small angular rotations of the port 72. Positioning port 72 so that rotating port 72*a* continues to receive the expanding gases over a longer time interval will increase the torque applied to the rotor 720 by the pistons 734. However, positioning the port 72 so that the rotating port 72*a* receives the expanding gases when a piston 734L is nearer TDC (i.e., by rotating the band 72B in the reverse direction of the rotation of the engine) will reduce the torque imparted to the rotor 720. In other words, when the engine is under low load conditions, the post 72 should open sooner to rotating port 72*a*, under less pressure. As engine speed or load increases, the position of the circular band 72B and hence port 72 is adjusted in the direction of rotation of the engine.

Electronic state of the art devices for monitoring engine load (not shown) are preferably provided to continually adjust the position of the circular band 72B to achieve optimal engine performance. The double-headed directional arrow appearing in FIG. 10 depicts the afore-mentioned rotational movements of the band 72B.

Figure 13:
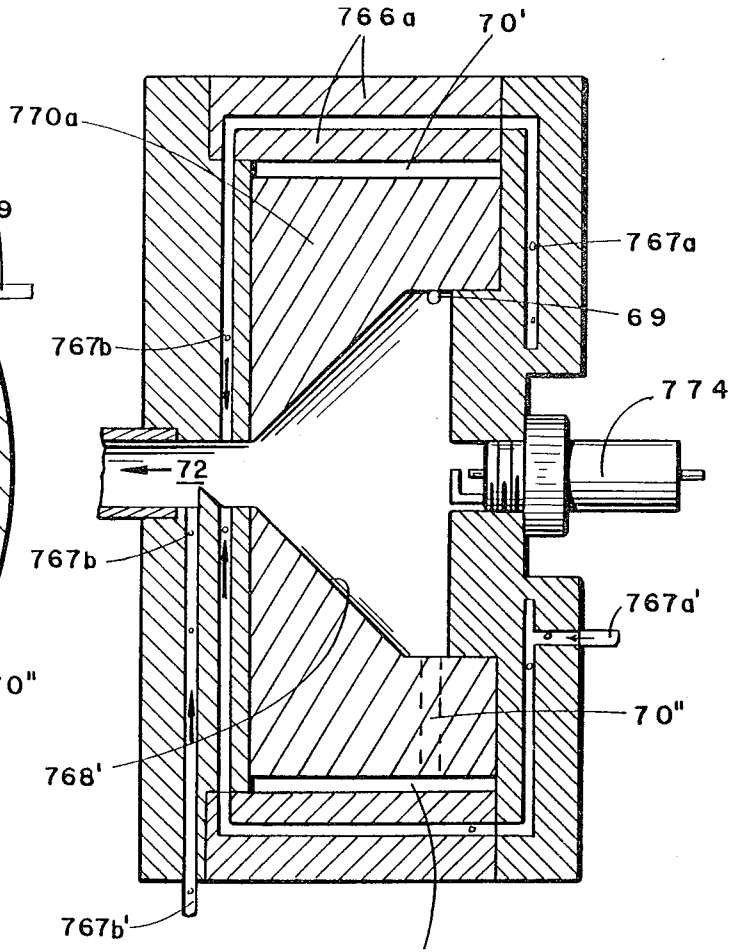
FIG. 13 is a vertical sectional view of the combustion chamber.
Figure 12:
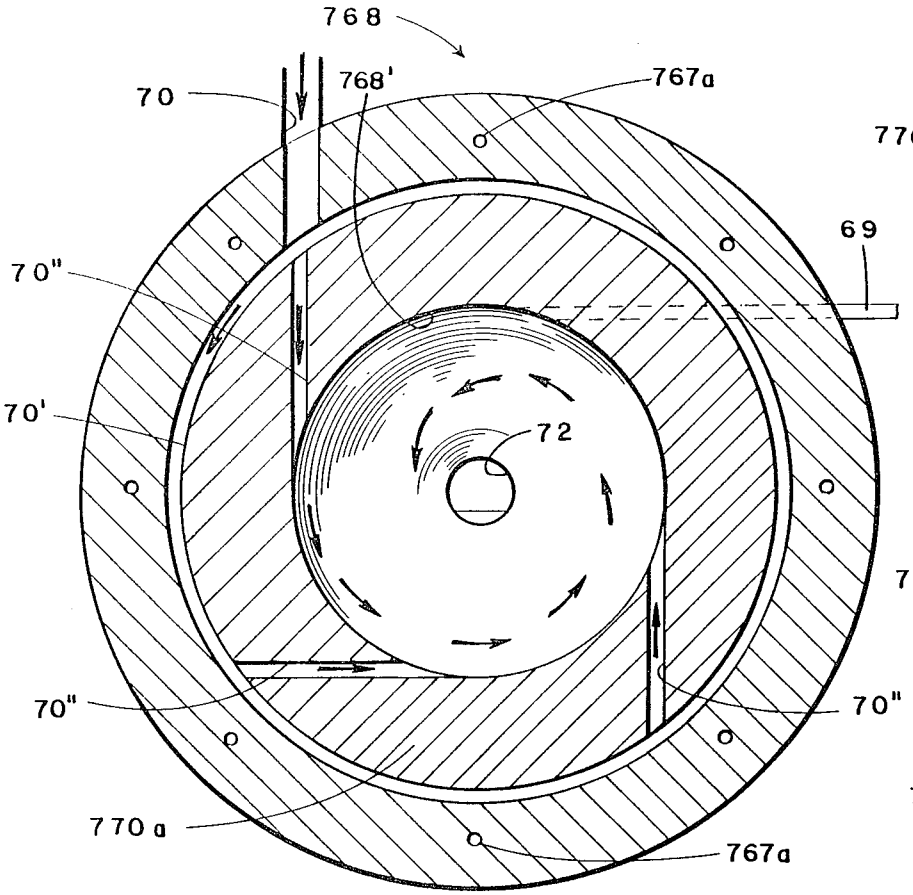
FIG. 12 is a horizontal sectional view of the combustion chamber.

Turning now to the disclosure of the improved combustion chamber, designated 768 in FIGS. 12 and 13, it will be noted that the improved chamber shares several features of construction with the chambers of the above-identified application. Specifically, the chamber 768' is of frusto-conical form, igniter 774 is conventional, and compressed air and fuel enter the chamber 768 tangentially through ports 70 and 69, respectively, to provide a swirling, thorough mixture thereof, and the combusted fuel continually exits the chamber 768 through discharge port 72. As in the earlier-disclosed embodiments, the tangential entry of fuel and air serves to retain the mixture in a circumferential motion as indicated by the directional arrows in FIG. 12 so that centrifugal forces acting upon the mixture assure that only the thoroughly combusted, and therefore lighter-in-weight gases exit chamber 768' through port 72 and different ones, sequentially, of the rotating ports 72*a* associated with the power bank of pistons 734L.

Distinguishing the chamber 768 is the provision of multiple, circumferentially-spaced, tangentially-disposed compressed air in ports 70'', each of which is in fluid communication with an air channel 70' that surrounds the chamber 768', in fixed spaced relation thereto. Interposed between the combustion chamber 768' and the air belt 70' is the metallic block 770*a* in which the chamber 768' is formed. The block 770*a* serves as a heat exchanger, and the compressed air flowing in a circular motion through belt 70' is accordingly further pre-heated prior to entering the chamber 768', as desired, to reduce the amount of fuel needed. The airflow through the chamber-encircling belt 70' also serves to cool the chamber 768', as desired.

Figure 14:
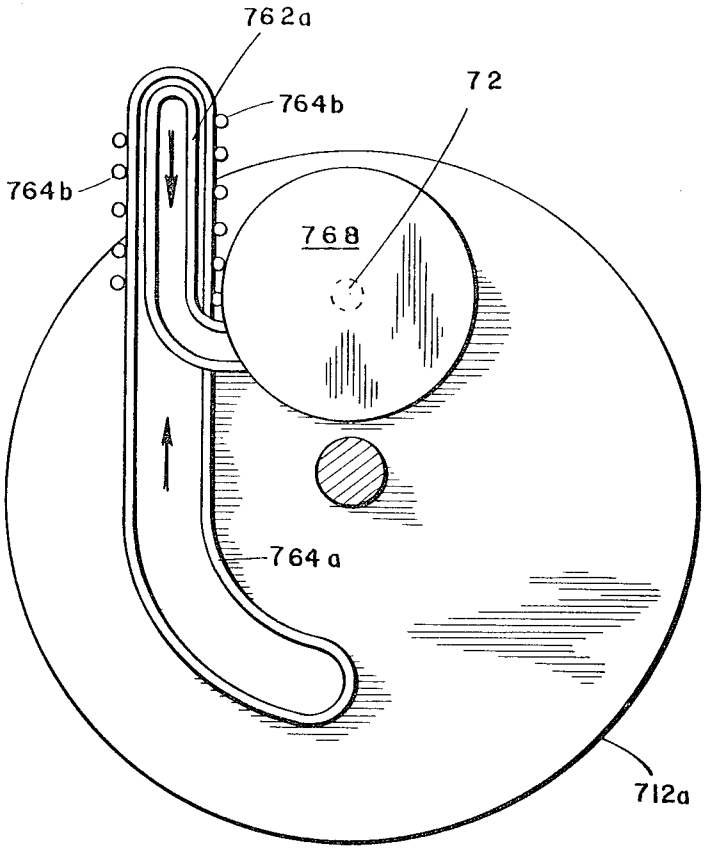
FIG. 14 is an end schematic diagram of the compressed air pre-heating means shown in FIG. 11.

The preferred disposition of the chamber 768 relative to the engine 710 is best depicted in FIG. 14. The exhaust jacket 764*a* that envelopes the compressed air conduit 762*a* is also shown clearly in FIG. 14. A coil 764*b*, also shown in FIG. 14, carries water to pre-heat such water prior to entering the inlet 767*a*'.

Further distinguishing the novel combustion chamber 768 is a novel steam injection system that increases engine efficiency. It is known that the injection of water or water vapor into a fuel mixture, prior to combustion thereof, increases the thoroughness of the fuel-burning process. Unlike the known water-injection systems, however, the inventive system injects the water vapor as the combusted fuel exits the combustion chamber.

A thin layer of water 767*a* (FIG. 13) is pumped through 764*b* and around the chamber 768' so that the heat of the channel and of the chamber 768' elevates the temperature of the water 767*a* until it enters its vapor state, indicated as 767*b*, whereupon it is pumped into the discharge port 72 as indicated by the directional arrows in FIG. 13. The water inlets are indicated as 767*a*',767*b*'. Additional water 767*a* or steam 767*b*, as preferred, may be pumped into the combustion chamber discharge outlet 72 as indicated at 767*b*'.

FIGS. 15A and 15B depict the manner in which the stationary circular band 72B is water cooled. The standard components of a typical water-cooling means, such as the circulating pump, the radiator, the thermostat means, etc., are not shown. Water enters and exits the circular band 72B as indicated by the directional arrows appearing in FIG. 15A. Annular water-carrying channels, not shown, are formed interiorly of the band 72B. The stationary band adjacent the compressor bank of pistons 734R need not be water cooled.

FIG. 15B depicts the sealing rings 758', end wall 716L, and thrust bearings 712*b*, 772*b* that abut the housing 712 and the band 72A, respectively, to allow the movement shown in FIG. 10. The bearings 712*b*, 772*b* do not appear in FIG. 1, for simplicity purposes.

Figure 16A:
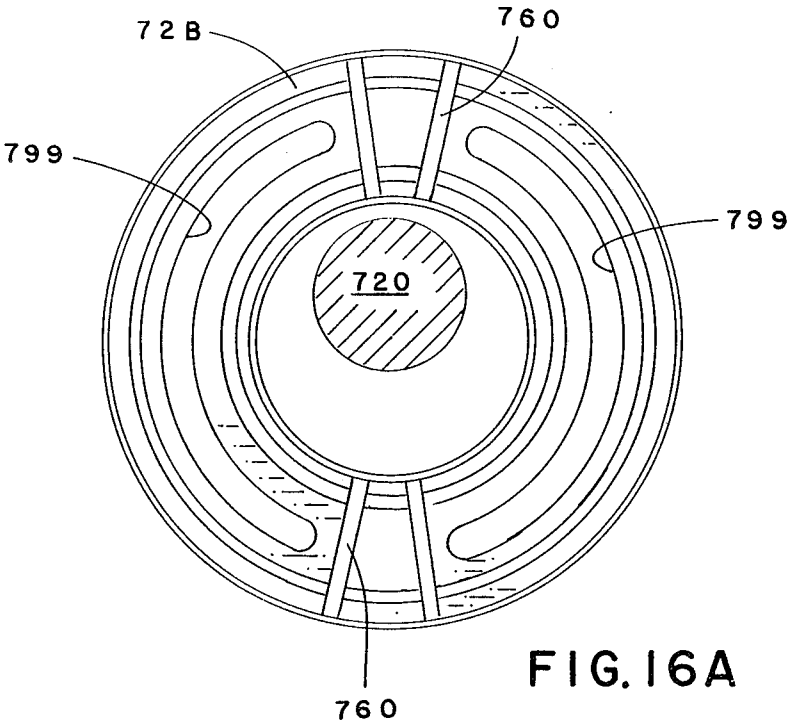
FIG. 16A is an end elevational view of the non-rotating circular band associated with the hydraulic pump and motor embodiment of the invention.
Figure 16B:
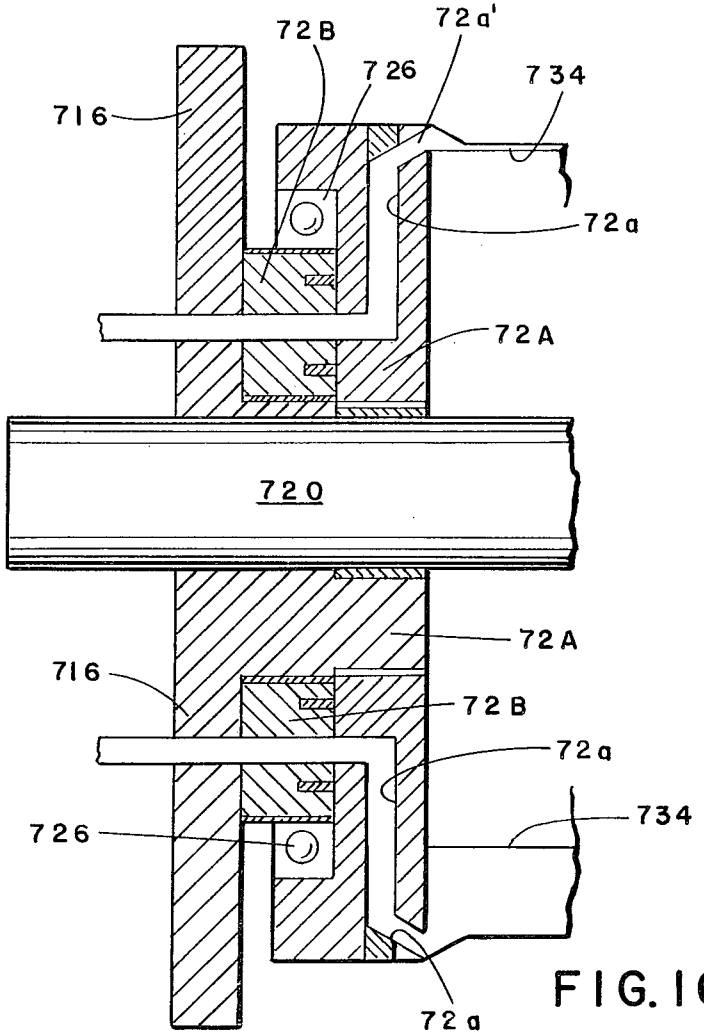
FIG. 16B is a vertical sectional view of the circular band shown in FIG. 16A, showing one hydraulic fluid-pumping piston in its TDC position, and another piston in its BDC position.

It is clear that the engine just described is adaptable to perform any number of functions and is adaptable to operate as a general purpose fluid displacement device. For example, the compressor bank of pistons 734R can be operated as an air compressor or as a vacuum pump. Further, a third bank of pistons can be connected in driven relation to the engine 710 and used as a hydraulic pump or motor. FIGS. 16A and 16B show a circular band 72B that is provided with two (2) elongate arcuate perforate portions, collectively designated 799. FIG. 16B schematically depicts a given piston 734 in its TDC position and its generally opposed counterpart in its BDC position.

Hydraulic fluid, not shown, flows on a continuous, alternating basis into and out of each cylinder 732 attendant reciprocation of the pistons 734. The fluid enters and exits each cylinder 732 via channel 72*a*, which channel is in fluid communication with hydraulic motors (not shown). Such motion results, as is known, in a continuous, uninterrupted flow of fluid that drives the hydraulic motors.

In a contemplated 4-wheel drive automotive application, four of such hydraulic motors, not shown, are associated with different ones of the wheels of the vehicle, all four (4) of such motors being driven by the extra bank of pistons. A vehicle drive so constructed eliminates the need for the usual transmission means, the differential, and the universal joints.

For a 2-wheel drive vehicle, two (2) hydraulic motors are provided, one associated with different ones of the driving wheels, thereby eliminating the need for a differential. A single motor can also be provided in 2-wheel drive applications, in which application the need for a differential continues.

The effectiveness of the inventive sealing means, described hereinabove in connection with FIGS. 3C–3G and 3H, 3I, provides positive and effective starting even under load. No power is lost, due to the absence of leakage, when the hydraulic pump is started or when it operates. The pump is thus said to exhibit positive action. Due to the substantial incompressiblity of hydraulic fluid, the perforate portions 799, 799 need not be disposed in radial proximity to the cylinders 732, as in the engine embodiment described hereinabove. It should be observed in FIG. 1 that the channels 72*a*, 70*a* are substantially longitudinally disposed, and therefore extend radially inward only to a nominal degree, due to the compressibility of gaseous fluid. Accordingly, the arcuate perforate portions 799, 799 that communicate with the rotating channels 72*a*, 70*a* intermittently to sequentially allow flow of hydraulic fluid therethrough as aforesaid, are disposed substantially radially inwardly of the housing 712, as shown in FIG. 16B. Thus, the diameter of the concentric annular sealing rings 758' is substantially smaller than the diameters of such rings in engine applications. The smaller diameter alleviates the load on the radially-disposed wiper vanes 760', to a substantial degree.

TWIN BANK, 4 CYLINDERS PER BANK EMBODIMENT

Figure 17:
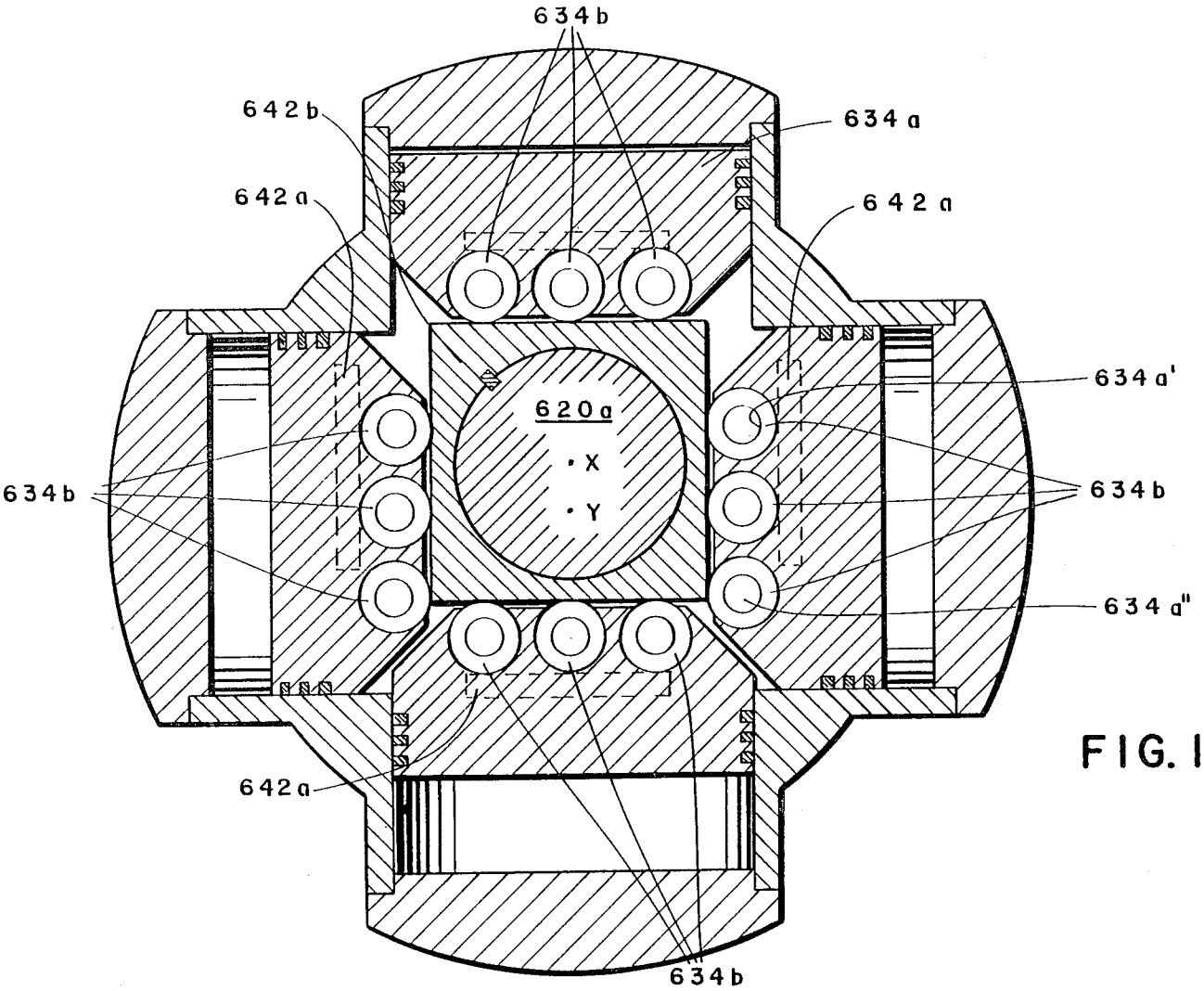
FIG. 17 is a vertical sectional view of an alternate yoking means, showing a square-in-section roller support surface keyed to the drive shaft.

Greater volumes of fluid displacement are attainable in embodiments of the engine having four (4) cylinders in each of the two axially-spaced banks, wherein said cylinders and complementally formed pistons received therein are equiangularly disposed about the axis of rotation of a square-in-section medial portion of a drive shaft 620*a*, as shown in FIG. 17.

The point designated X in FIG. 17 represents the spin axis of the drive shaft 620*a* and the point Y represents the axis of symmetry of the stationary housing. As in the other embodiments, the amount of offset therebetween determines the length of the piston stroke of the pistons 634*a*.

FIG. 17 further reveals that each piston 634*a* is provided with a plurality, preferably three (3) of longitudinally-disposed, equispaced, parallel bores 634*a*' adjacent the radially-innermost portion of each piston 634*a*, for reception therethrough of a plurality of axle means 634*a*'', one axle means individual to each of said bores in each of said pistons. Each axle 634*a*'' carries, preferably, three (3) independently rotatable wheel means, the outermost ones of said wheel means being collectively designated 634*c* in FIG. 18, and the intermediate wheels being designated 634*b* collectively. All of the wheel-carrying axle means 634'' are parallel to one another, and are parallel to and offset from the respective axes of symmetry designated as X and Y.

Figure 18:
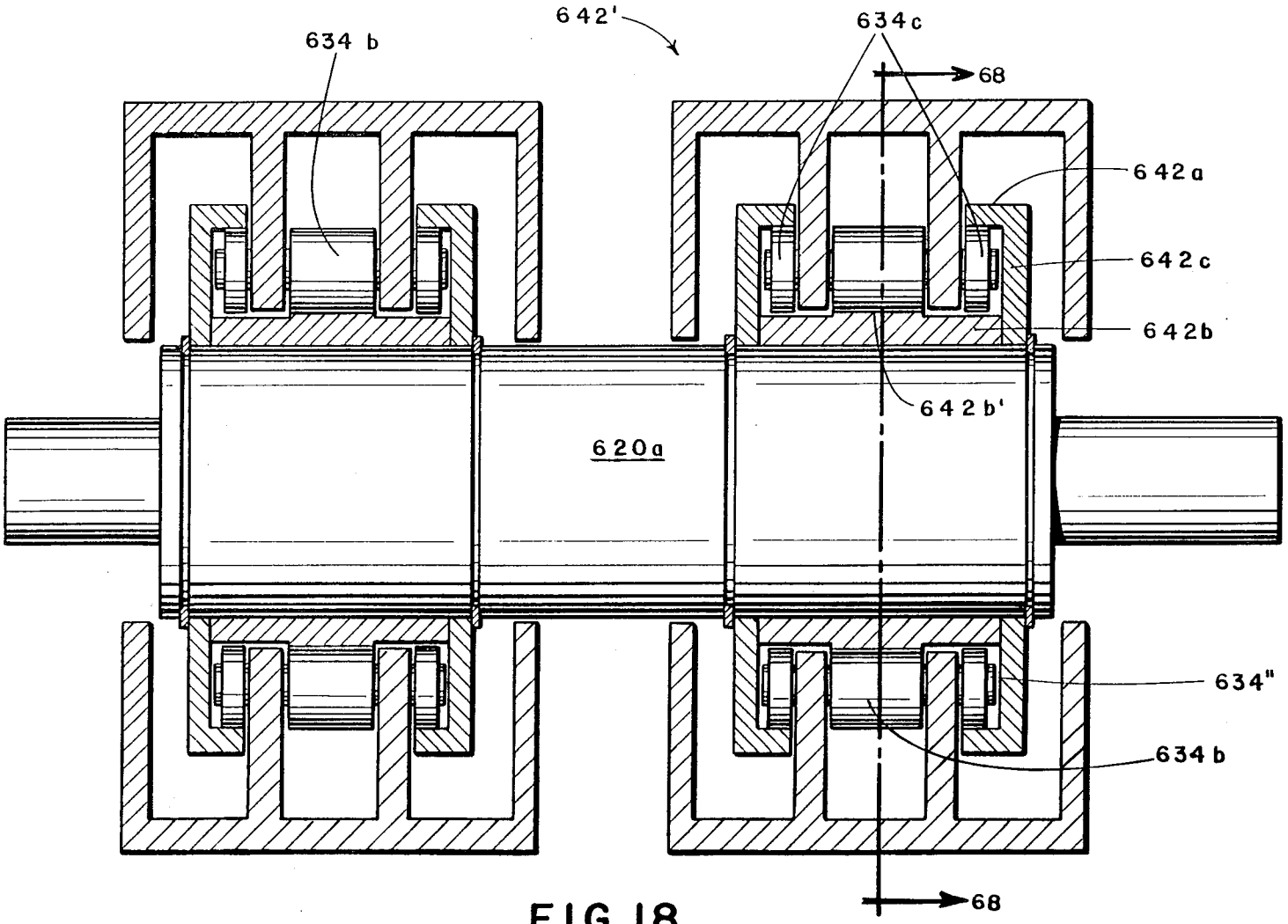
FIG. 18 is a longitudinal sectional view of the yoking means shown in FIG. 17.

FIG. 18 further shows that the outermost wheel means 634*c* associated with each piston 634*a* do not bear against the drive shaft 620*a*, but are instead in continuous rotatable engagement with a yoking means 642*c* that rigidly interconnects diametrically-opposed pairs of pistons 634*a*, to effect in unison movement therebetween. Pistons 634*a* and associated yoking means 642*c* extending normal to the plane of the drawing paper are not shown, for simplicity purposes.

Figure 19:
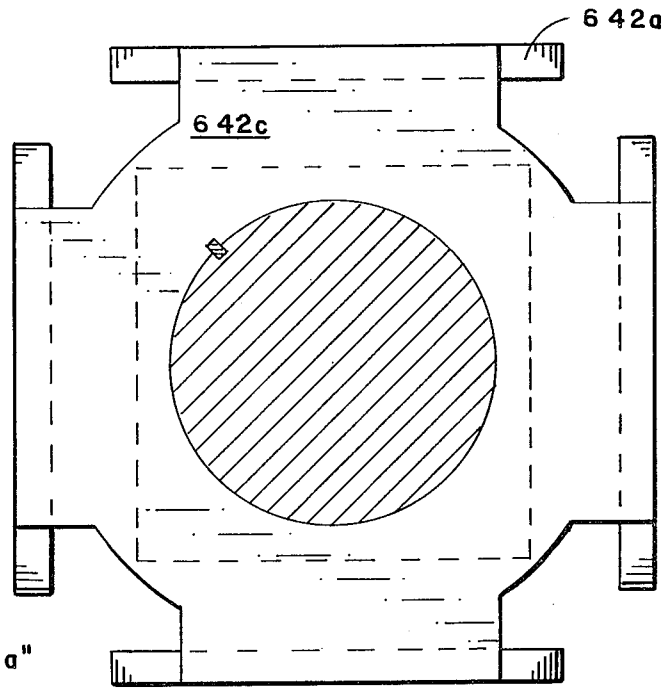
FIG. 19 is an end elevational view of the yoking means shown in FIGS. 18 and 19.

The yoking means 642c is an integrally-formed member that forms a continuous ring around the medial portion of the drive shaft 620a, as best seen in FIG. 19.

As best shown in FIG. 18, the base portion 642b (which is keyed to the drive shaft medial portion) has a raised portion 642b' that rotatably engages the middle wheels 634b associated with each piston 634a. The outer wheels 634c are rotatably engaged with portions 642a of the yoking means 642', and portion 642c of the yoking means 642' is specifically structured to interconnect wheel 634c—contacting portion 642a to the yoking means base portion 642b, so that wheels 634b rotate relative to portion 642b', while wheels 634c rotate relative to portion 642a.

Figure 20:
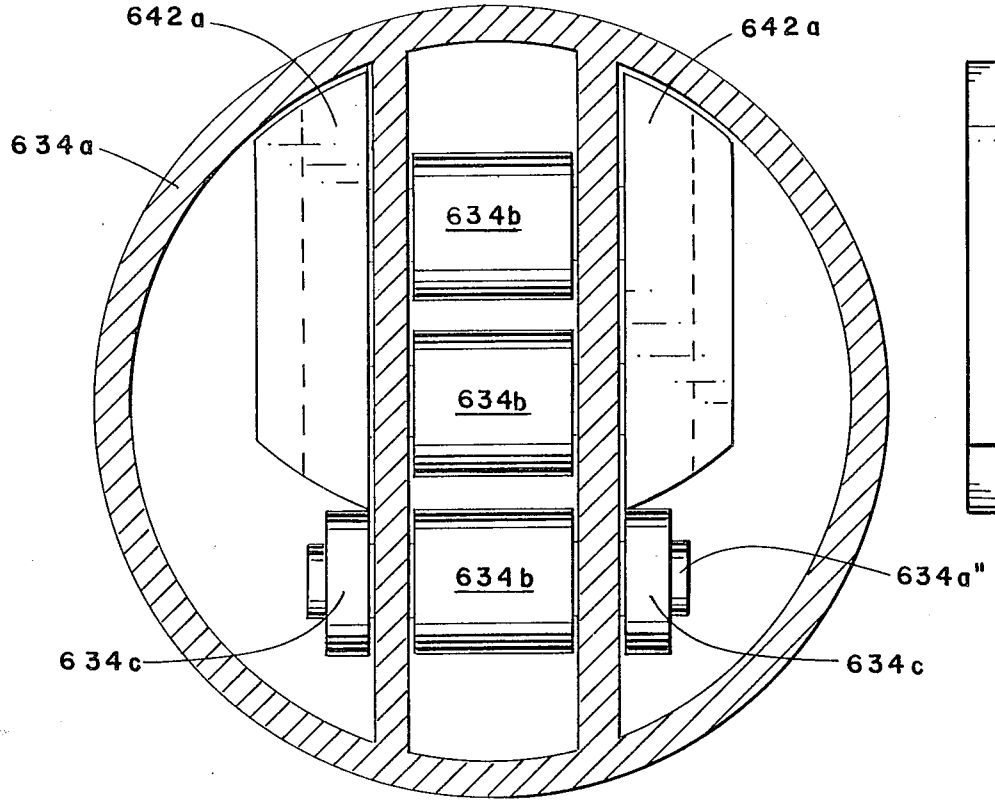
FIG. 20 is a bottom plan view of a piston, showing how the radially-innermost end of the piston is rotatably engaged by the roller means that form a part of the yoking means shown in FIGS. 17, 18, and 19.

As aforesaid, the offset distance of the drive shaft 620a axis X from the axis of symmetry Y of the non-rotating housing determines the throw of the pistons 634. Therefore, the wheels 634b, 634c rotate relative to the surfaces 642b', 642a, respectively, as aforesaid, attendant engine operation, and a row of wheels associated with a given piston will transiently override yoking portion 642a by an amount equal to the offset distance between X and Y, as clearly shown in FIG. 20, and as also shown in FIG. 17 for the pistons in the 90° and 270° positions.

Of course, the phrase "yoking means" as employed in connection with this embodiment has a significantly different meaning than the same phrase employed earlier herein in connection with the yoking means 742, in that the present yoking means are self-yoking pistons, thereby obviating the need for the yoking means designated hereinabove as 742.

TWO STAGE AIR COMPRESSOR

Figure 21:
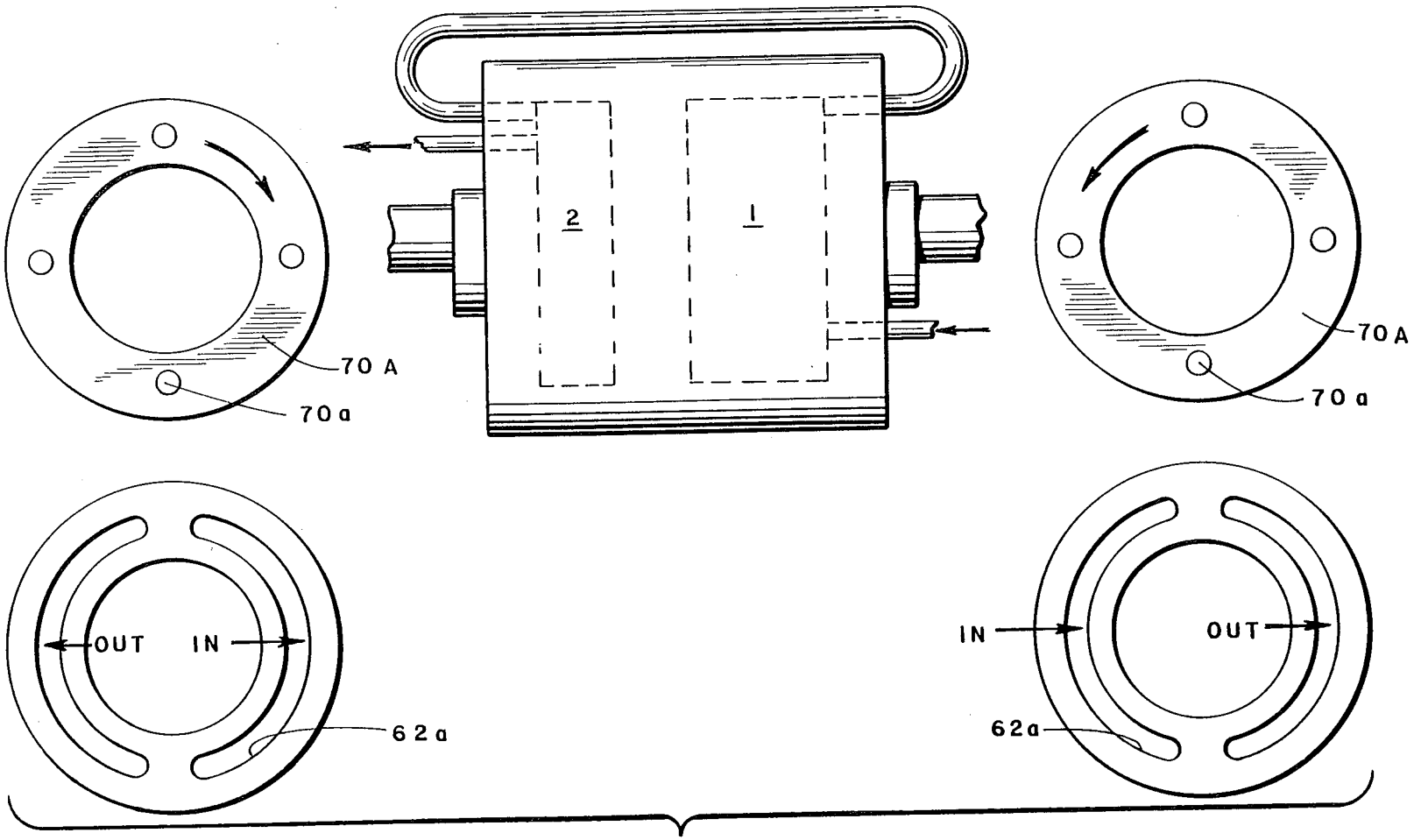
FIG. 21 is a composite view of the circular bands, shown in end elevation, and of the two-stage air compressor, shown schematically in side elevation with which said circular bands are used.

FIG. 21 shows, diagrammatically, a two-stage air compressor the operation of which depends upon the inventive use of rotating ports 70a and cooperatively-disposed stationary circular bands 70A. 70A having ports 62a formed therein. The directional arrows appearing in FIG. 21 show the angular rotational direction of the rotating ports 70a, and the resultant air flow direction through the compressor means. The direction of the air flow through the ports 62a is indicated in FIG. 21 in script.

The larger volume of the low pressure first bank of pistons, designated 1, relative to the smaller volume of the second bank of pistons, designated 2, is typical of air compressor installations, the second bank 2 having the higher pressure therein.

The means for rotating the rotor 720 in the direction as shown by directional arrows in FIG. 21 can be the engine 710, or any conventional motor means.

COMPOUND EXPANSION ENGINE EMBODIMENTS

Figure 22:
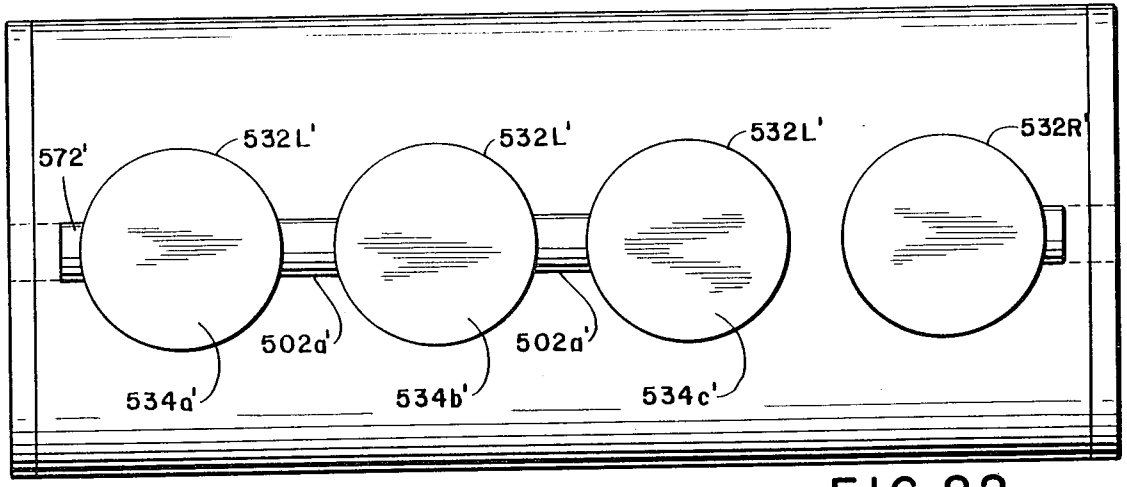
FIG. 22 is a top plan view of the compound expansion embodiment.

A compound expansion engine can be provided, in view of the teachings of this invention, having plural banks of expansion/exhaust pistons that reciprocate in unison. FIG. 22 represents, diagrammatically, how the plural motor banks, only one cylinder 532L' per bank being shown, are interconnected via duct segments 502a' so that combusted gases exiting the combustion chamber as at 572' impinge simultaneously upon the pistons 534a', 534b', and 534c'. Since the total volume into which the combusted gases expand (i.e., the collective volume of cylinders 532L') is three (3) times greater than in non-compound expansion embodiments, the gases will expand to nearly atmospheric pressure before being exhausted, thereby producing more useful work from the engine.

Figure 23:
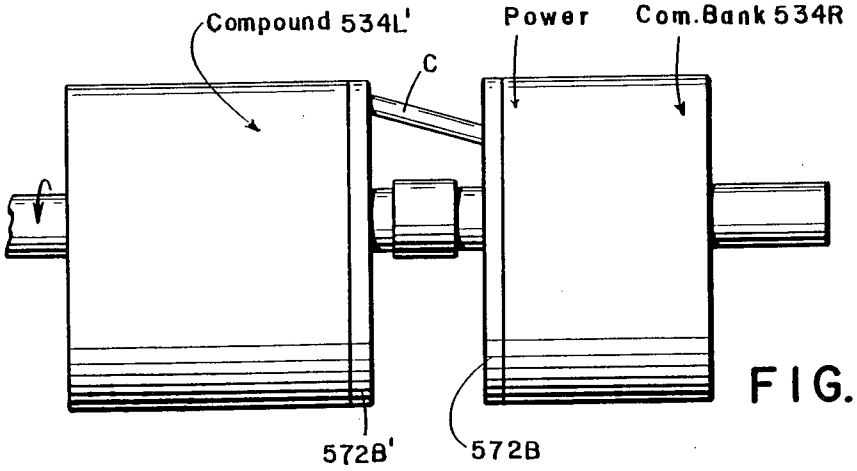
FIG. 23 is a side elevational view of the compound expansion engine embodiment, showing how the compound stages are connected to the primary engine.

As shown in FIG. 23, another embodiment comprises the engine 510 which includes a compressor bank of pistons 634R and a high pressure power bank of pistons 534L, together with an axially-adjacent bank of low pressure power pistons 534L'. The two banks of power pistons 534L, 534L' are in fluid communication with one another via conduit C. The physical disposition of the stationary circular bands 572B and 572B' are shown in detail in FIGS. 24 and 25, respectively. Band 572B is in direct fluid communication with the combustion chamber outlet 72, it being understood that band 572B' is in communication with the burner discharge port 72 only via conduit C. The operation of the subject compound expansion engine is as follows:

Upon a given piston in bank 534L rotating approximately 50°, its rotating port 502' enters into fluid communication with arcuate ports 564a' formed in stationary circular band 572B (FIG. 24) and arcuate port 564a'' formed in stationary circular band 572B' (FIG. 25) via conduit C, thereby causing the gases to impinge upon a piston in the bank designated 534L' in FIG. 23.

Figure 24:
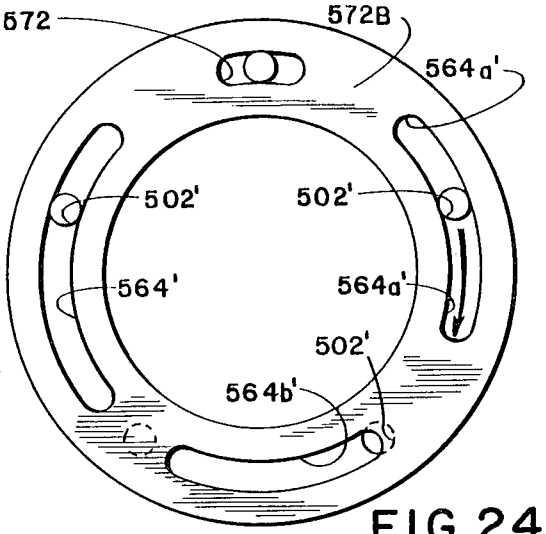
FIG. 24 is an end elevational view of the non-rotating circular band associated with the compound expansion banks of pistons.
Figure 25:
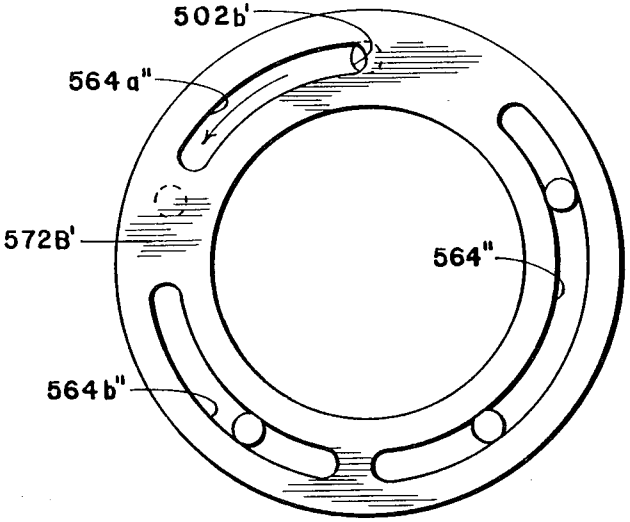
FIG. 25 is an end elevational view of the non-rotating circular band associated with the power bank of pistons of the primary engine.

Before a second rotating port 502' reaches a stationary arcuate port 564a', the first-mentioned port 502' will have passed (i. e., misaligned with) the port 564a', thereby preventing the intermixing of two unequal gas pressures. When the first port 502' reaches 564b'' (FIG. 24), it is in communication with the second bank 534L' via 564b'' (FIG. 25) until that piston reaches approximate BDC. The second bank of pistons 534L' can be larger or multiple as shown in FIG. 22. When port 502' travels past BDC for approximately 50°, it opens into the exhaust port 564' (FIG. 24). Simultaneously, rotating port 502b' (FIG. 25) reaches exhaust port 564'' at the approximate BDC of its associated piston in the 534L' bank.

FURTHER SELF-YOKING PISTON EMBODIMENTS

Figure 26B:
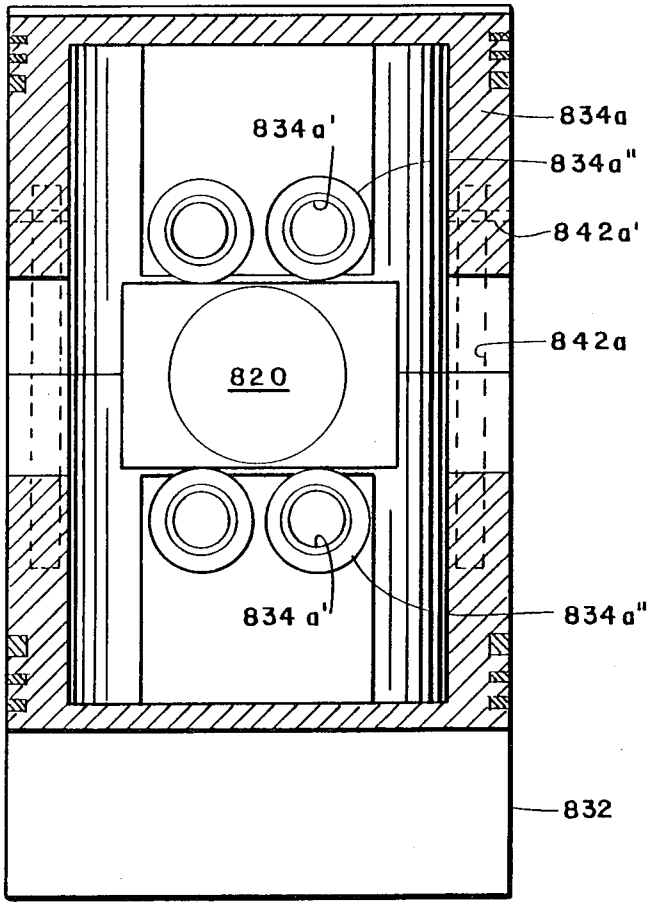
FIG. 26B is a partially cut-away side elevational view of the yoking means shown in FIG. 26A.
Figure 26A:
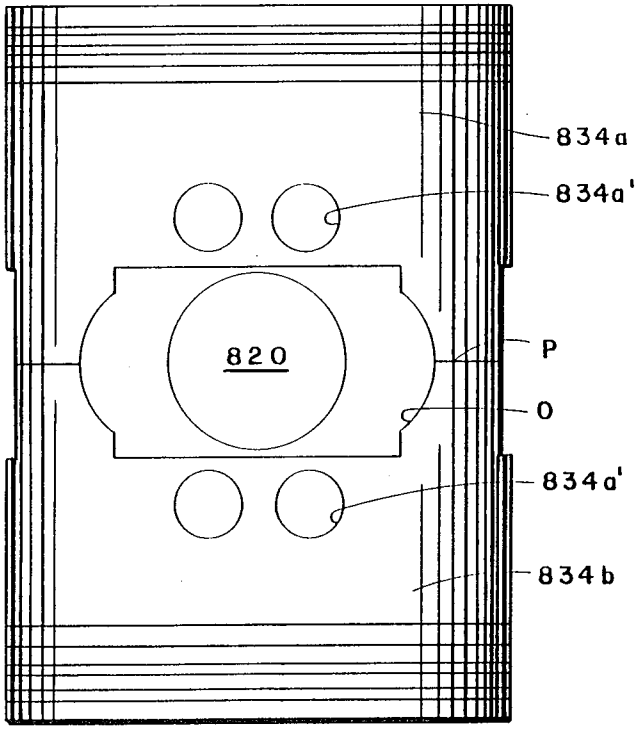
FIG. 26A is a side elevational view of an alternate yoking means which essentially comprises a bifurcated double-headed piston.
Figure 26C:
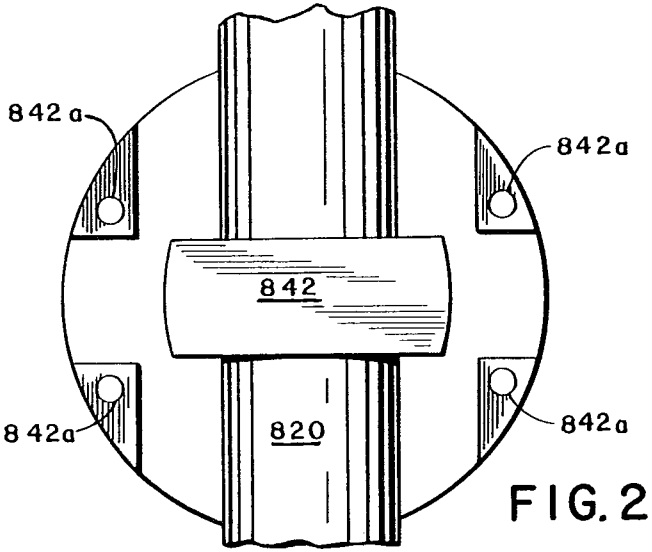
FIG. 26C is a cut-away top plan view of the assembly shown in FIG. 26B.
Figure 26D:
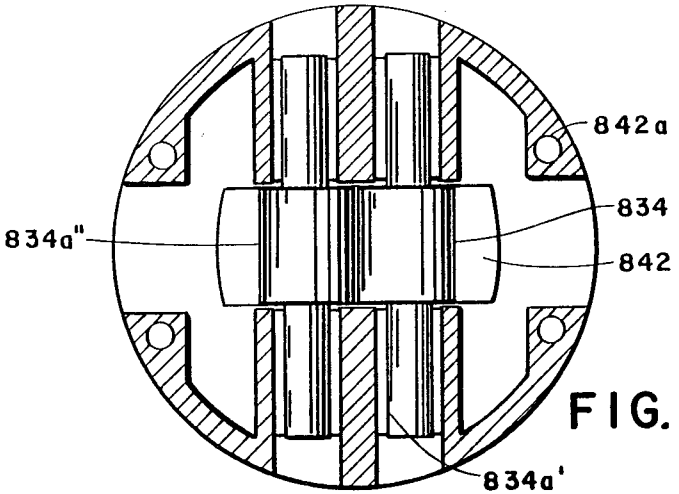
FIG. 26D is a horizontal sectional view of the assembly shown in FIG. 26B.

FIGS. 26A–26D illustrate another construction that results in uniform, or yoked, motion between the pistons 834 and the rotor 820. The self-yoking piston 834 depicted in FIG. 26A is formed of two (2) substantially identical half portions 834a and 834b, and is therefore said to have bilateral symmetry. The half portions 834a and 834b are fixedly secured together by elongate pin means, collectively designated 842a, as best seen in FIGS. 26B, 26C. Each pin means 842a is received within a complementally-formed bore individual to such pin means 842a so that the opposite ends of each pin means 842a lie in different ones of the piston halves 834a, 834b, and the opposite ends are secured by truncated pin means 842a'.

The parting line for the piston halves 834a, 834b is designated P, and the opening through which the rotor 820 passes is designated 0. It should be understood that the piston halves 834a, 834b could be integrally-formed, thereby obviating the need for the pin means 842a and 842a'. However, the machining of an integrally-formed piston 834 is not believed to be practical.

It is apparent that numerous means are available with which to join the piston halves 834a, 834b, it being understood that the means described is intended to merely be illustrative of many other means.

Communication between the piston halves 834*a*, 834*b* and the rotor 820 is achieved by the provision of a block-like element, or roller support surface 842, which may be keyed to the rotor 820 and accordingly conjointly rotatable therewith, or the block 842 and rotor 820 may be integrally-formed, as shown.

A plurality of roller means, collectively designated 834*a*'', are carried by elongate roller pin means, collectively designated 834*a*', and are specifically disposed to rotatably and continuously bear against opposite planar faces of the roller support surface 842. In this manner, communication between the rotor 820 and the pistons 834 is achieved.

FIGS. 27A–27D depict a similar self-yoking piston 834 having half portions 834*a*, 834*b*, roller support surface 842, roller means 834*a*'', and roller pin means 834*a*'. However, in this embodiment, the roller means 834*a*'' are constrained to rotatably and continuously bear against the roller support surface 842 by bridle ring members, collectively designated 842*b*, which perform, essentially, the function of the pin means 842*a*, 842*a*' of the embodiment shown in FIGS. 26A–26D.

Figure 27:
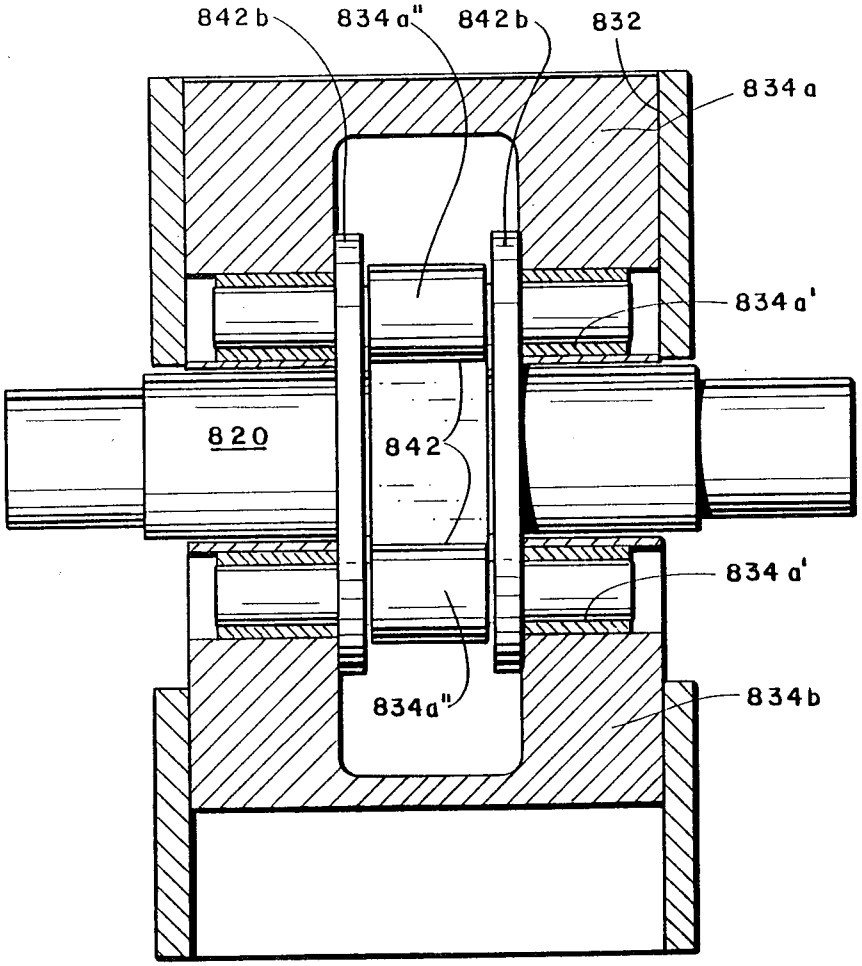
FIG. 27 is a vertical sectional view of an alternate yoking assembly employing bridle rings to maintain the separate halves of the bifurcated piston in yoked relation to one another.
Figure 27B:
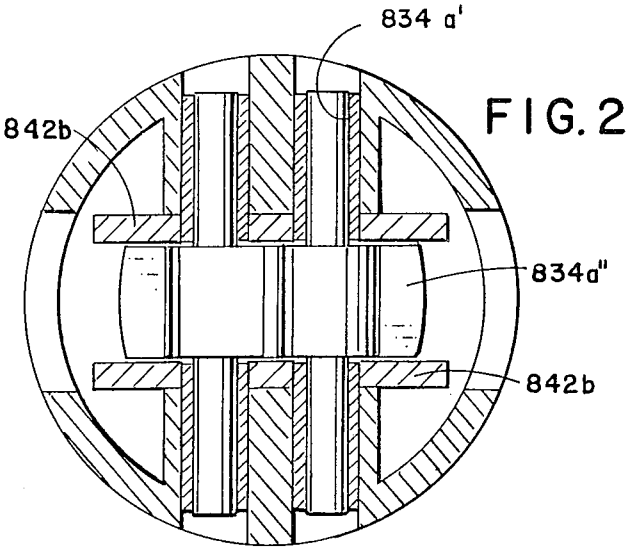
FIG. 27B is a horizontal sectional view of the yoking means of FIG. 27.
Figure 27C:
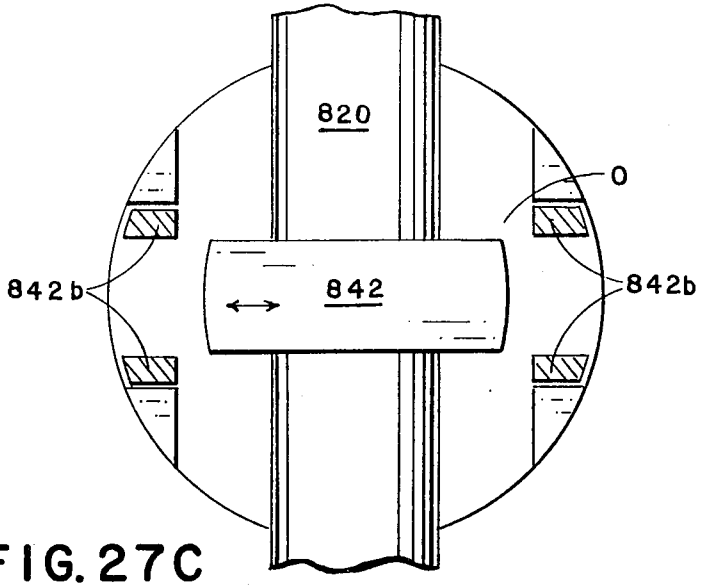
FIG. 27C is a top plan, partially cut away view showing the roller support surface and respective portions of the bridle rings of the yoking means of FIG. 27.
Figure 27A:
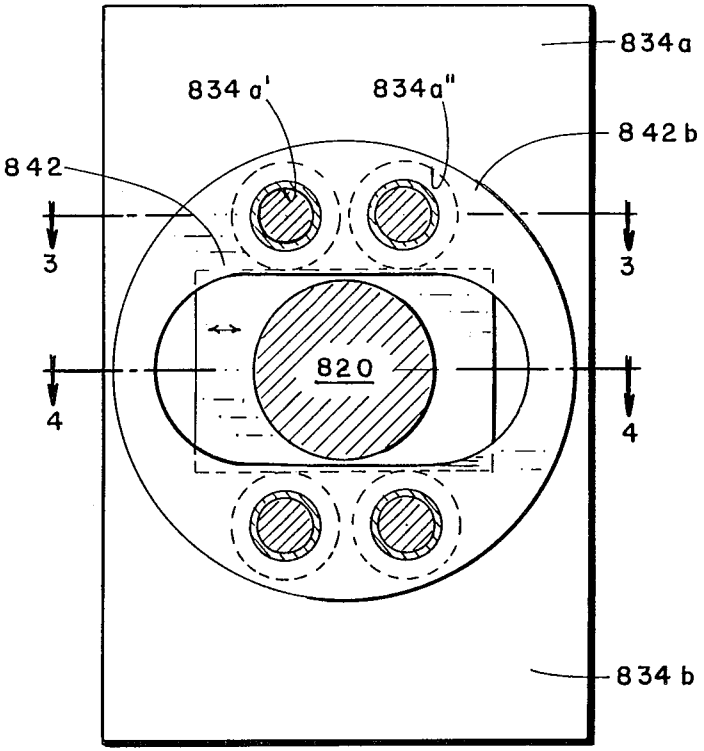
FIG. 27A is a partial vertical sectional and partially end elevational view of the yoking assembly employing bridle rings.

As best shown in FIGS. 27B and 27C, the rings 842*b* are disposed in the hollow core O of the piston 834, and abut opposite ends of each roller means 834*a*''.

FIG. 27 shows a piston half 834*a* in its top dead center position, and its opposing half 834*b* in its bottom dead center position.

Figure 28:
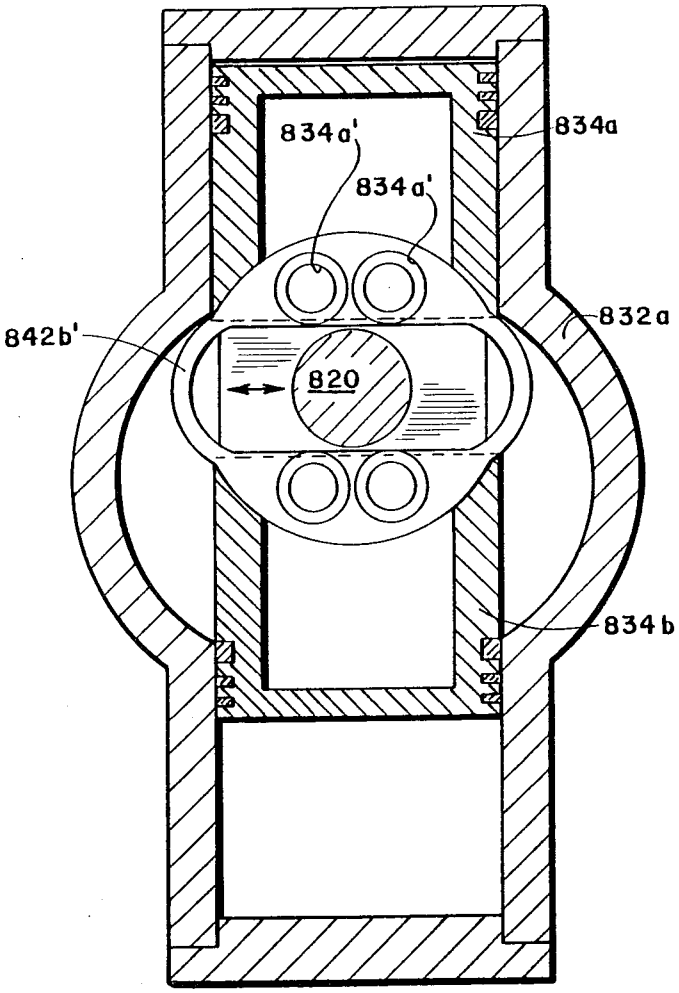
FIG. 28 is a vertical sectional view of a bridle ring yoking means for pistons in an engine wherein the throw of the pistons is substantially greater than is the throw of the pistons in the first-illustrated embodiment of the engine.

FIG. 28 shows a self-yoking piston 834 of the type having bridle rings 842*b*', but having a longer piston stroke than the earlier-described embodiments. The longer piston stroke is due to the greater amount of eccentricity of the rotor 820 relative to the frame axis of symmetry. Accordingly, the piston chamber or cylinder portion designated 832*a* is flared outwardly to accomodate the bridal ring and the greater travel of the roller support surface 842.

The directional arrow appearing in FIG. 28 represents the oscillation of the roller support means 842.

PRESSURE RELIEF VALVE EMBODIMENTS

In the earlier-described embodiments, after a given rotating port 72*a* passes from one sealing ring-defined volume V to another, the combusted gases remaining in the passed volume V maintain unwanted pressure upon the sealing rings defining such volumes, thereby adding needless friction which must be overcome by the engine.

FIGS. 29–35 show inventive means for reducing such friction by exhausting pressurized combusted gases after a given port 72*a* misaligns with a given volume V attendant rotation of such port 72*a*. FIG. 29 shows four (4) rotating ports 72*a*, in a four cylinder embodiment, formed in a rotating circular band 72A that has four cutout portions 759*a* formed in its periphery. Each cut-out portion 59*a* trails its associated rotating port 72*a* as the ports rotate, and provides an opening through which combusted gases under pressure in a given volume V can escape after the respective rotating ports 72*a* have misaligned therewith.

More specifically, the non-rotating circular band 72B is provided on its interior, or rotating circular band 72A-abutting face, with a plurality of circular volume-defining sealing ring members 759. The volumes designated V are circular in configuration, whereas the volumes V' intermediate of the circular volumes V are generally circular, being infringed upon as shown in FIG. 30 by the flanking circular volumes V to a limited extent. The rings that define each volume V or V' are narrow in their respective transverse dimensions, whereas the ring 759' that surrounds the burner inlet is relatively thicker in its corresponding dimension.

The greater thickness of the burner inlet ring 759'prevents the escape of combusted gases from the volume V associated with the burner inlet, as desired, since the cut-away portions 759*a* do not extend radially inward a sufficient distance to allow such escape, as shown in FIG. 32.

On the other hand, the relatively thinner rings 759 allow the cut-out portions 759*a* to respectively enter into fluid communication with the volumes V, V', as shown in FIG. 31, to allow the escape of combusted gases trapped therein, as desired for the reasons stated above.

An alternate embodiment is shown in FIGS. 33 and 34, wherein alternate ones of the reduced area rings are offset radially inward as shown in FIG. 33 so that the respective cut-out portions 759*a* do not come into fluid communication therewith, as shown in FIG. 34.

As shown in FIG. 33, the infringed-upon volume V' has its sealing ring segments 759*b* set into a channel formed in the interior face of rotating circular band 72A (or 70A) that has an axial depth less than the axial depth of the channel into which is set the sealing rings 759. In this manner gases under pressure are prevented from escaping either volume V or V' by passing under said rings 759 or 759*b*.

The method of constructing the rings is shown in FIG. 35. The channel for the partial segments 759*b* is cut first, after which circular recesses are formed in flanking relation to the first-cut channel, thereby rendering the channel dis-continuous and providing the channels into which are inserted the partial ring segments 759*b*. Plugs 759*c*, two of which are shown in FIG. 35, are then inserted into said circular recesses and the channels for the sealing rings 759 are then cut.

It will thus be seen that the objects set forth above, and those made apparent by the preceding description, are efficiently attained, and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

1. A rotating cylinder continuous external combustion engine, comprising, a non-rotatable cylindrical in configuration frame assembly having a longitudinally disposed axis of symmetry, a rotatably mounted rotor means, said rotor means eccentrically disposed relative to the longitudinal axis of symmetry of said frame means.

a first and second bank of axially spaced cylinder heads disposed in radial relation to said axis of symmetry, a first and second bank of complementally formed pistons, each piston mounted in a different one of said cylinder heads, a pair of rotatably mounted, longitudinally spaced circular band members disposed at opposite ends of said frame assembly and having a rotational axis coincident with said frame axis of symmetry, said circular bands abutting and rotating conjointly with associated ones of said cylinder heads, said rotor mounted to, for conjoint rotation with, said rotatable circular band members, a pair of non-rotatably mounted, lognitudinally spaced circular band members disposed at opposite ends of said frame assembly longitudinally outward of and adjacent to said rotatably mounted circular bands, a plurality of substantially longitudinally disposed channel means, each channel means formed in a different one of said first and second banks of cylinder heads and extending through an adjacent portion of an associated rotatable circular band, a plurality of port means formed in both of said non-rotatable circular bands, and extending completely therethrough so that transient alignment of said rotating channels and said non-rotating ports attendant operation of the engine provides valving means for controlling the operation of the engine, said non-rotatable circular bands having sealing means on the interior faces, respectively, thereof, to inhibit leakage of fluid under pressure when said rotating channels are in alignment with the imperforate portions of said non-rotatable circular bands and to separate the angularly adjacent rotating channels of each bank from each other, said respective interior faces of said non-rotatable circular band members having first and second concentric grooves of annular configuration formed therein, said grooves having predetermined, different diameters so that a first groove of greater predetermined diameter lies radially outward of a second groove, said respective interior faces further having a plurality of radially disposed grooves of predetermined depth greater than the depths of said concentric grooves formed therein, a plurality of annular sealing rings, a plurality of radial sealing vanes, a plurality of bias means, said annular sealing rings and radial sealing vanes respectively disposed in different ones of said grooves and urged outwardly thereof by said bias means so that said rings and vanes make sliding contact with said rotating circular bands, respectively, said rings and vanes collectively defining therebetween a plurality of fluid-tight volumes from which said fluid under pressure cannot escape, said prevention of fluid loss increasing the efficiency of said engine.

2. The engine of claim 1, wherein said annular sealing rings and said radial sealing vanes are joined at each of their respective intersections by a longitudinally disposed cylinder means set into the respective interior faces of said nonrotatable circular bands, said cylinder means having complementary slots into which the ends of corresponding ones of said rings and vanes are inserted.

3. The engine of claim 1, wherein the respective interior faces of the non-rotating circular bands are provided with a plurality of circular-in-configuration sealing ring members, said sealing ring members respectively set into a complementally formed groove formed in said respective interior faces and biased into sealing relation with the adjacent rotating circular band, alternate ones of said sealing ring members infringing upon the space defined by a sealing ring member adjacent thereto in substantially flanking relation thereto, such that the sealing ring members are effectively arrayed in telescoping relation to one another so that the respective rotating ports are disposed in surrounded relation to said sealing ring member at all times, and said channels associated with alternate ones of said sealing ring members having an axial depth different from the axial depth of the other channels.

4. The engine of claim 1, wherein a plurality of pressure-relief openings are formed in the rotating circular band associated with said first bank of pistons, each of said openings trailing an associated rotating port relative to the direction of circular band rotation, each of said openings circumferentially spaced from its associated port by a distance slightly greater than the diameter of said circular sealing rings so that the combusted gases maintained under pressure between said rotating and non-rotating circular bands by said sealing ring members are exhausted through said openings attendant misalignment of said respective rotating ports and said sealing ring members.

5. The engine of claim 1, wherein pressure relief openings are formed in communication with the periphery of said rotating circular band and extend radially inward therefrom, the radially innermost portions thereof successively entering into fluid communication with the volumes respectively defined by said sealing ring members attendant rotation of the engine.

6. The engine of claim 1, wherein preselected ones of said sealing ring members are set radially inward so that the radially inward extending openings do not come into fluid communication therewith.

7. The engine of claim 1, wherein a sealing ring member associated with a combustion chamber inlet of said engine has a radially thickened transverse dimension relative to the corresponding dimension of the other sealing rings so that said radially-inward-extending pressure relief openings do not come into fluid communication therewith attendant operation of the engine.

* * * * *